United States Patent [19]

Ohbayashi et al.

[11] Patent Number: 4,797,350

[45] Date of Patent: Jan. 10, 1989

[54] PROCESS FOR FORMING DYE-IMAGE USING A DEVELOPER COMPRISING AN IMAGE STABILIZER, A HYDROXYLAMINE AND NOT CONTAINING BENZYL ALCOHOL

[75] Inventors: Keiji Ohbayashi; Shigeo Chino; Mitsuhiro Okumura, all of Hino; Kaoru Onodera, Odawara, all of Japan

[73] Assignee: Konishiroku Photo Industry Co., Ltd., Tokyo, Japan

[21] Appl. No.: 35,078

[22] Filed: Apr. 6, 1987

[30] Foreign Application Priority Data

Apr. 16, 1986 [JP] Japan ..... 61-87489

[51] Int. Cl.[4] ..... G03C 7/16; G03C 7/40

[52] U.S. Cl. ..... 430/380; 430/372; 430/377; 430/464; 430/467; 430/484; 430/485; 430/478; 430/551; 430/552; 430/553

[58] Field of Search ..... 430/375, 372, 377, 380, 430/464, 467, 484, 485, 478, 250, 551, 552, 553

[56] References Cited

U.S. PATENT DOCUMENTS

| | | | |
|---|---|---|---|
| 3,287,124 | 11/1966 | Green et al. | 430/484 |
| 3,287,125 | 11/1966 | Green et al. | 430/484 |
| 3,293,034 | 12/1966 | Green et al. | 430/484 |
| 3,806,345 | 4/1974 | Willems et al. | 430/484 |
| 3,996,054 | 12/1976 | Santemma et al. | 430/377 |
| 4,252,892 | 2/1981 | Case | 430/357 |
| 4,452,884 | 6/1984 | Leppard | 430/551 |
| 4,517,283 | 5/1985 | Leppard et al. | 430/512 |
| 4,666,826 | 5/1987 | Takada et al. | 430/551 |

FOREIGN PATENT DOCUMENTS

| | | |
|---|---|---|
| 0095722 | 5/1983 | European Pat. Off. . |
| 0159912 | 4/1985 | European Pat. Off. . |
| 158446 | 8/1985 | Japan . |

*Primary Examiner*—Paul R. Michl
*Assistant Examiner*—Patrick A. Doody
*Attorney, Agent, or Firm*—Frishauf, Holtz, Goodman & Woodward

[57] ABSTRACT

A process for forming a dye image is disclosed, in which a silver halide photographic light-sensitive material having a silver halide emulsion layer is developed by a color developer comprising an aromatic primary amine and an N,N- dialkylhydroxylamine. The silver halide emulsion layer contains a hydrophobic dye-forming coupler and a compound selected from the group consisting of compounds having a sterically hindered phenol group and polyalkylpiperidine compounds or the water soluble acid salt thereof. The dye image having a high maximum density and a high light-fastness can be obtained when the color developer without benzyl alcohol is used.

17 Claims, No Drawings

PROCESS FOR FORMING DYE-IMAGE USING A DEVELOPER COMPRISING AN IMAGE STABILIZER, A HYDROXYLAMINE AND NOT CONTAINING BENZYL ALCOHOL

FIELD OF THE INVENTION

The present invention relates to a process for forming a dye-image by treating a silver halide photographic lignt-sensitive material through color development, in particular, to a process for forming a dye-image having an excellent light-fasteness as well as a higher maximum density even if color developing is effected with a color developer from which benzyl alcohol has been removed.

BACKGROUND OF THE INVENTION

Generally, when forming a dye-image with a silver halide photographic light-sensitive material, the silver halide photographic lightsensitive material (hereinafter simply referred to as a light-sensitive material) which comprises a support, provided thereupon, at least one silver halide emulsion layer containing a hydrophobic dye-forming coupler is, after imagewise exposing, treated with a color developer containing an aromatic primary amine as a color developing agent (hereinafter simply referred to as a color developing agent), then further treated with a bleacher as well as a fixer (or, with a bleach-fixer) to produce a dye-image.

In this case, it is widely known in the art that a blue-sensitive silver halide emulsion, a green-sensitive silver halide emulsion and a red-sensitive silver halide emulsion are used as siliver halide emulsions, and that couplers respectively forming a cyan dye-image, a magenta dye-image and a yellow dye-image are used as hydrophobic dye-forming couplers.

Recently, the strong need for light-sensitive materials capable of rapid processing has been mounting in the photographic art. In other words, lightsensitive materials are subjected to the running treatement with an automatic developing machine provided within every processing laboratory. It has been more and more strongly demanded that to improve the service for end users the development be finished within the same day, or, more seecifically, within one hour of acceptance of films to be developed.

In principle, in order to accelerate the development, each of the color developing process, bleaching process, fixing process or, bleach-fixing process as well as washing or stabilizing process must be independently accelerated. Among these processes, the acceleration of color developing process is, both in terms of photographical technology and practical use, of great significance. In order to accelerate color developing process, such means are most commonly employed as to raise the developing temperature, to raise the pH, to decrease the ion concentration of bromide which is the principal component of a developing inhibitor, to raise the concentration of color developing agent, or the like.

However, raising the temperature of color developer drastically accelerates the degradation of color developing agent due to oxidation by oxygen, therefore, is not suitable for continuous treatment in the long time span. Such a degradation becomes especially significant when the temperature is set greater than 40° C. Similarily, when the pH of color developer is raised, the coupling reaction of the oxidized product of the color developing agent and the coupler unexpectedly becomes impossible at a certain pH level. Especially, the pH of more than 11, therefore, it is impossible to raise indefinitely the pH of the color developer.

At the same time, a color developer often contains benzyl alcohol as a color forming accelerator. When such a benzyl alcohol is incorporated into the color developer, a dye-image featuring a higher maximum density and gradation can be obtained. More specifically, to obtain the satisfactory color forming properties when treating a color photographic light-sensitive material through color developing with a color developer containing benzyl alcohol, usually 10 ml to 15 ml or more of such a benzyl alcohol is incorporated into 1 liter color developer. However, because the benzyl alcohol has a poor watersolubility, it is normally necessary to add as an auxiliary solvent a considerable amount of multivalent alcohol such as ethylene glycol, diethylene glycol, triethylene glycol, glycerin or the like, in order to solubilize benzyl alcohol.

However, since such multivalent alcohols and benzyl alcohols have the greater pollution loads including BOD (biochemical oxygen demand) and COD (chemical oxygen demand), it is desirable in view of the environmental pollution to minimize or to totally eliminate the use of these substances.

Incidentally, it has been more strongly demanded recently that the photographic light-sensitive material, comprising a reflective support being typified by a color photographic paper, can provide a dye-image featuring a great fastness.

In view of such a feature, especially in terms of the light fastness of a dye image, the methods to select a coupler featuring a smaller discoloration and color-fading, to use an ultraviolet-ray absorvent for protection of dye-image against ultraviolet-rays or to use a anti-fading agent for prevention of fading due to light have been conventionally proposed.

For instance, the method for improving the light fastness of a dye-image by incorporating and blending an ultraviolet-ray absorvent into a color photographic material significantly improves the light fastness of a dye-image, when compared to the case where no ultraviolet-ray absorvent is incorporated. However, such a method has a disadvantage that the dye-image is stained due to the coloring of the ultraviolet-ray absorbent itself when such an amount of the absorbent as to provide satisfactory effect is used. Additionally, despite its use, the ultraviolet-ray absorbent has no preventive effect against the fading of dye-image due to the visible ray, thus limiting the improving effect on the light fastness by means of the ultraviolet-ray absorbent.

In the meantime, the examples of an anti-fading agent which prevents the fading due to light are as follows: bisphenols disclosed in Japanese Patent Examined Publications No. 31256/1973 and No. 31625/1973; pyrogallols and gallic acid and esters thereof disclosed in U.S. Pat. No. 3,069,262; alpha-tocopherol and acyl derivatives thereof disclosed in U.S. Pat. No. 2,360,290 and Japanese Patent Publication Open to Public Inspection hereinafter referred to as Japanese Patent O.P.I. Publication No. 27333/1976; 6-hydroxychromans disclosed in U.S. Pat. Nos. 3,432,300 and No. 3,574,627; 5-hydroxychroman derivatives disclosed in U.S. Pat. No. 3,573,050; 6,6'-dihydroxy-2,2'-bisspirochromans disclosed in Japanese Patent Examined Publication No. 20977/1974; organic metal-chelate compounds disclosed in U.S. Pat. No. 4,050,938, Japanese Patent O.P.I. Publications No. 62826/1979, No. 62987/1979, No. 82385/1979 and No. 82386/1979; 6,6'-dihydroxy-2,2'-bisspirochromandialkylethers disclosed in Japanese Patent Examined Publication No. 19765/1982; hydroquinonedialkylethers disclosed in Japanese Patent Examined Publication No. 24257/1981; compounds having sterically hindered phenol group and disclosed in Japanese Patent O.P.I. Publications No. 48535/1979 and No. 222853/1985; polyalkylpiperidine compounds disclosed in Japanese Patent Examined Publication No. 20617/1982, Japanese Patent O.P.I. Publications No. 114036/1983, No. 119351/1984 and No. 116747/1984.

Among these dye-image stabilizers, the above-mentioned compounds having sterically hindered phenol group as well as polyalkylpiperidine compounds are, as light stabilizers for yellow-dye-image and cyandye-image, favorably used. In other words, the compounds having sterically hindered phenol group as well as the polyalkylpiperidine compounds can improve the light fastness of a dy--image, without jeopardizing the dark-storability, or without causing the undesirable discoloration (stain) due to light, heat and moisture.

However, it was learned that the color forming properties are disadvantageously degraded, resulting in a deteriorated gradation and a decreased maximum density, when the light stabilization effect of such a compound having sterically hindered phenol group (hereinafter referred to as HP) as well as a polyalkylpiperidine series compound (hereinafter, PAP) are enhanced to the sufficient point.

Such a disadvantage is especially significant when benzyl alcohol contained in the color developer is eliminated from the color developer.

More surprisingly, it was learned that the light fastness of cyan- and yellow-dye-images obtained under such conditions of color developing with such deteriorated color forming properties is sometimes poorer than that obtained through the treatment with a color developer containing benzyl alcohol, and that in some cases the light fastness of dye-image obtained by treating the lightsensitive material containing the above-mentioned HP or PAP with a color developer containing no benzyl alcohol is poorer than the similar fastness of dye-image obtainable by treating the lightsensitive material containing no HP or PAP with a color developer containing benzyl alcohol.

The inventors have found through the devoted research that the deterioration in light fastness of dye image obtained by the treatment with the color developer containing no benzyl alcohol is caused by the use of hydroxylamine salt being contained in the color developer.

The above-mentioned hydroxylamine is an excellent preservative being contained in an ordinary color developer especially when it is used together with sulfurous ions, and is available at a lower price. Additionally, the hydroxylamine exerts only a minimal influence on benzyl alcohol.

SUMMARY OF THE INVENTION

The object of the invention is to provide a process for forming a dye-image having a high degree of light fastness of color-image as well as a high maximum density even if benzyl alcohol contained in a color developer is eliminated for prevention of environmental pollution and the rapid treatment is carried out.

The above-mentioned object of the present invention is achieved by a process for forming dye-image comprising the steps of:

imagewise exposing a silver halide photographic light-sensitive material which comprises a support, provided thereon, at least one silver halide emulsion layer containing a hydrophobic dye-forming coupler and at least one compound selected from the group consisting of compounds having sterically hindered phenol group and polyalkylpiperidine compounds, and color developing with a color developer containing an aroatic primary amine as a color developing agent and an N,N-dialkylhydroxylamine or a water soluble acid salt thereof.

DETAILED DESCRIPTION OF THE INVENTION

The compounds used with the invention and having sterically hindered phenol group are preferably those represented by the following formula [I].

Formula [I]

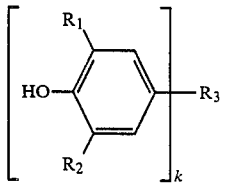

[wherein, $R_1$ and $R_2$ are each a straight chain or branched chain alkyl group having 3–8 carbon atoms, especially, a t-butyl group or a t-pentyl group. $R_3$ represents a k-valent organic group and k is an integer, 1–6.]

The k-valent organic groups represented by $R_3$ are as follows:

alkyl groups such as a methyl group, ethyl group, propyl group, butyl group, pentyl group, octyl group, hexadecyl group, methoxyethyl group, chloromethyl group, 1,2-dibromoethyl group, 2-chloroethyl group, benzyl group, phenethyl group and the like; alkenyl groups such as an aryl group, propenyl group, butenyl group and the like; multivalent unsaturated hydrocarbon groups such as an ethylene group, trimethylene group, propylene group, hexamethylene group, 2-chlorotrimethylene group and the like; unsaturated hydrocarbon groups such as a glyceryl group, digryceryl group, pentaerythrityl group, dipentaerythrityl group and the like; aliphatic cyclic hydrocarbon groups such a a cyclopropyl group, cyclohexyl group, cyclohexenyl group and the like; aryl groups such as a phenyl group, p-octylphenyl group, 2,4-dimethylphenyl group, 2,4-di-t-butylphenyl group, 2,4-di-t-pentylphenyl group, p-chlorophenyl group, 2,4-dibromophenyl group, naphthyl group and the like; a 1,2-, 1,3- or 1,4-phenylene group; arylene groups such as a 3,5-dimethyl-1,4-phenele group, 2-t-butyl-1,4-phenylene group, 2-chloro-1,4-phenylene group, naphthalene group and the like; 1,3,5-tri-substitutional benzene group and the like.

The examples of $R_3$ include, in addition to the above-mentioned groups, k-valent organic groups being bonded with an optional appropriate group selected from the above-mentioned groups via —O—, —S— or —$SO_2$— group.

The more favorable examples of $R_3$ are a 2,4-di-t-butylphenyl group, 2,4-di-t-pentylphenyl group, p-octylphenyl group, p-dodecylphenyl group, 3,5-di-t-butyl-4-hydroxylphenyl group and 3,5-di-t-pentyl-4hydoxylphenyl group.
K is an integer, preferably, 1–4.
The typical compounds expressed by the formula [I] are as follows. However, the present invention is not limited only to these examples.
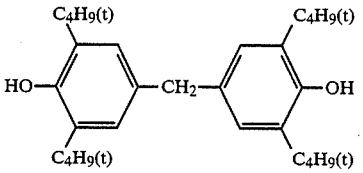
(I-1)
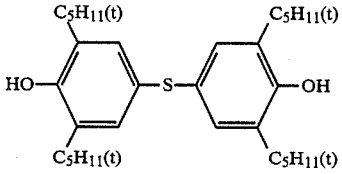
(I-2)
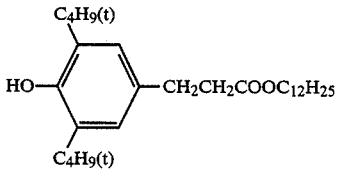
(I-3)
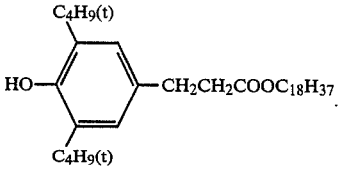
(I-4)
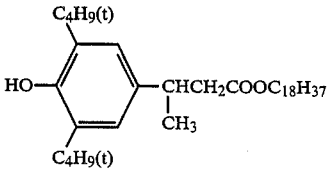
(I-5)
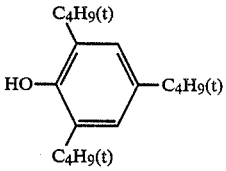
(I-6)
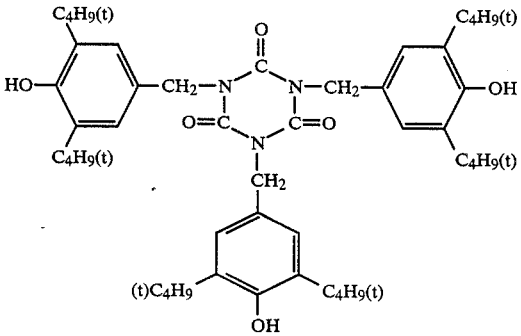
(I-7)
-continued
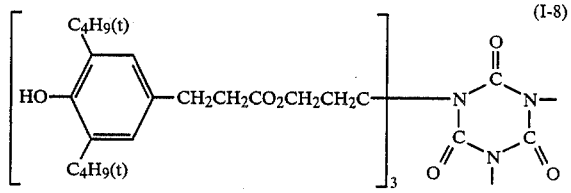
(I-8)
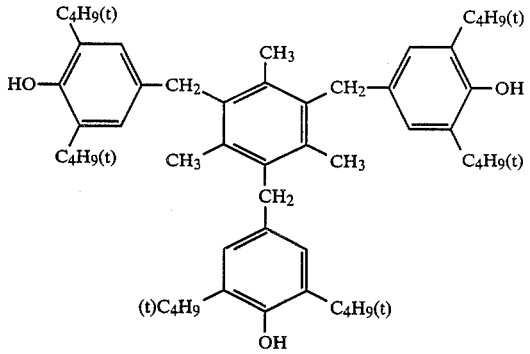
(I-9)
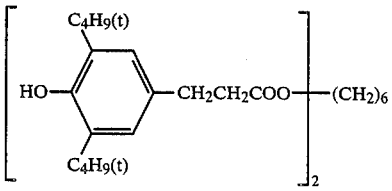
(I-10)
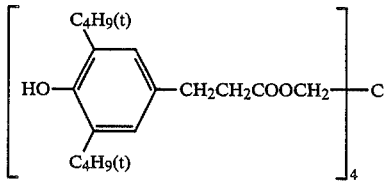
(I-11)
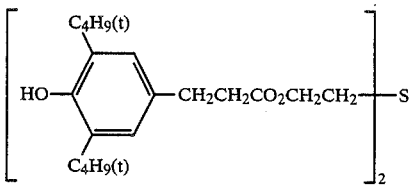
(I-12)
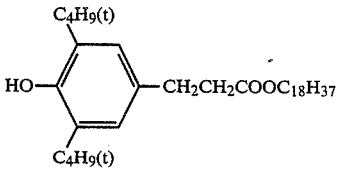
(I-13)
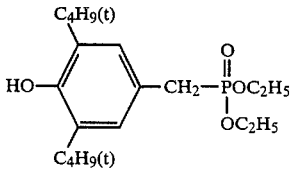
(I-14)

-continued
(I-15)
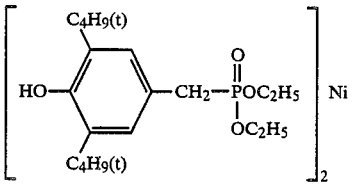
(I-16)
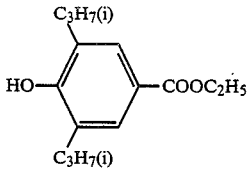
(I-17)
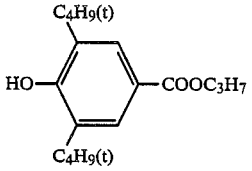
(I-18)
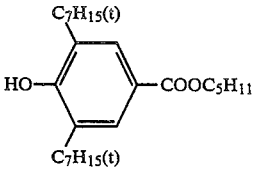
(I-19)
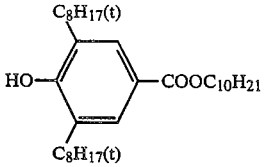
(I-20)
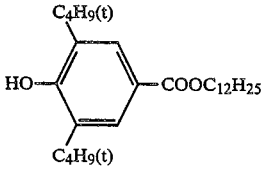
(I-21)
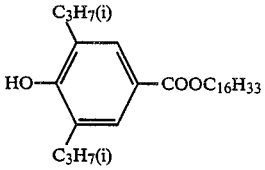
(I-22)
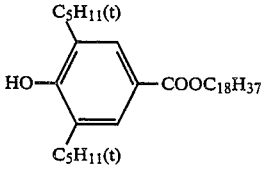
(I-23)
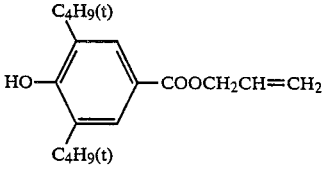
-continued
(I-24)
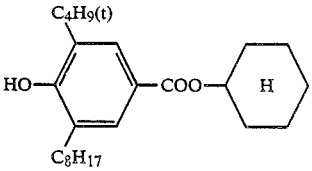
(I-25)
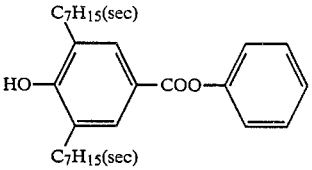
(I-26)
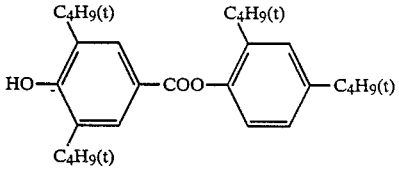
(I-27)
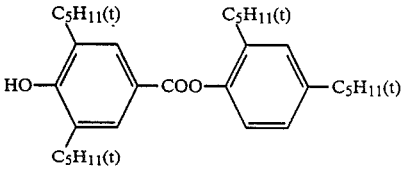
(I-28)
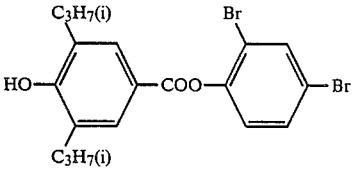
(I-29)
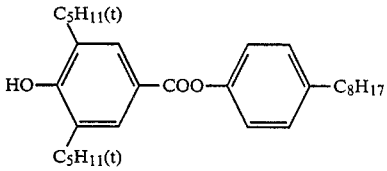
(I-30)
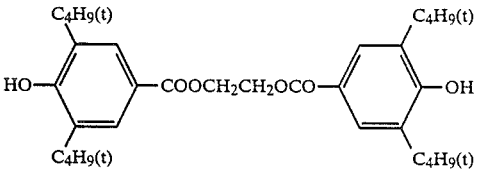
(I-31)
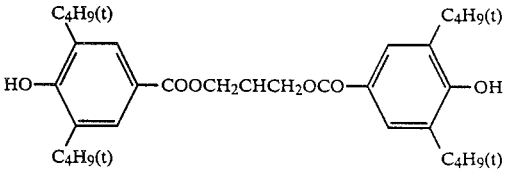

-continued
(I-32)
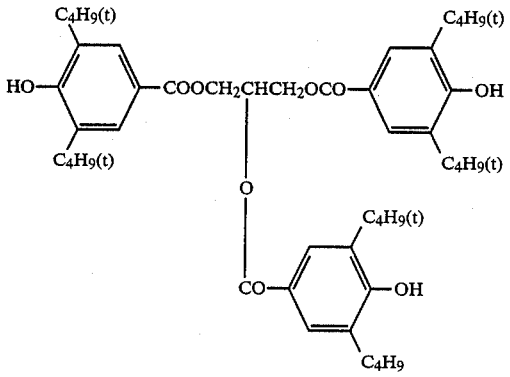
(I-33)
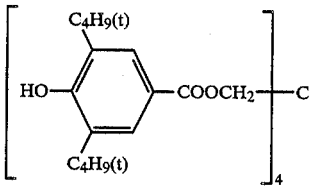
(I-34)
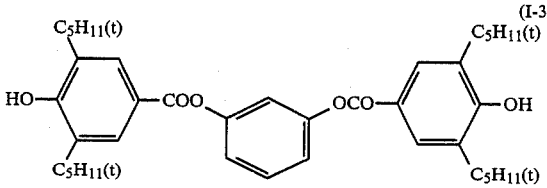
(I-35)
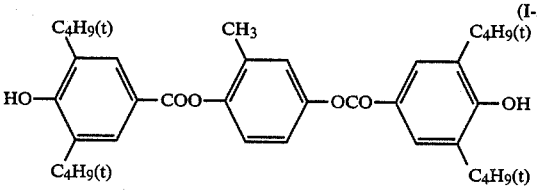
(I-36)
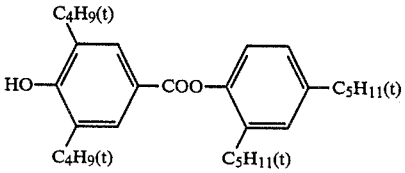
(I-37)
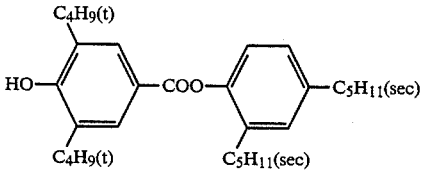
(I-38)
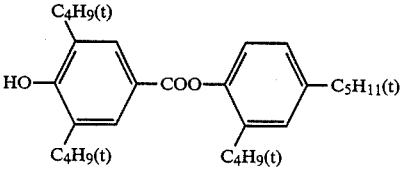
-continued
(I-39)
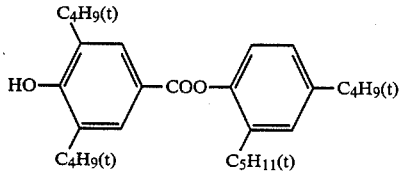
(I-40)
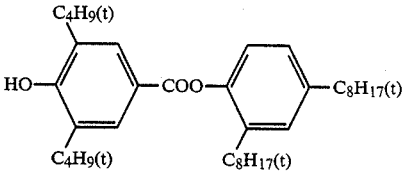
(I-41)
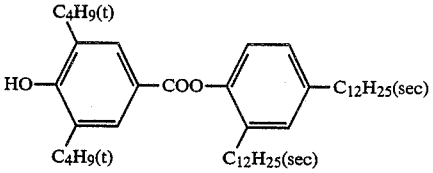
(I-42)
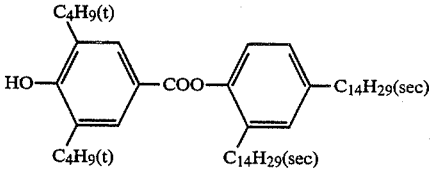
(I-43)
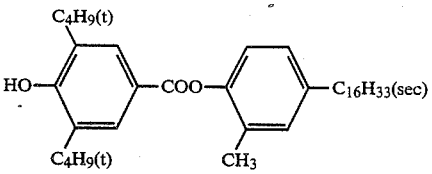
(I-44)
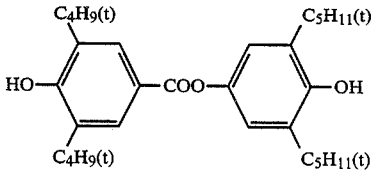
(I-45)
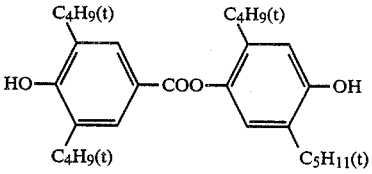
(I-46)
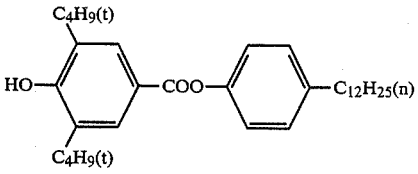
(I-47)
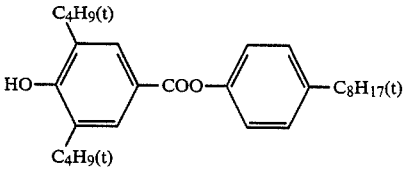

-continued (I-48)

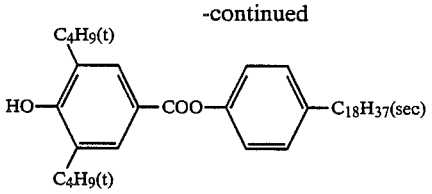

(I-49)

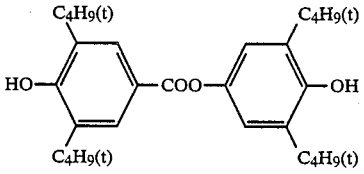

The polyalkylpiperidine series compounds are those expressed by the following formula [II].

Formula [II]

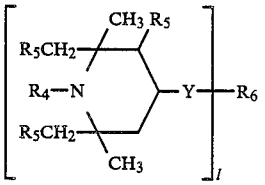

wherein, $R_4$ represents any of an alkyl group such as a methyl group, ethyl group, propyl group, butyl group, pentyl group, benzyl group and the like, an alkenyl group such as a vinyl group, aryl group, isopropenyl group and the like, an alkynyl group such as an ethynyl group, propynyl group and the like, an acyl group such as a formyl group, acetyl group, propionyl group, butylyl group, acryloyl group, propioloyl group, methacryloyl group, crotonoyl group and the like.

The more favorable groups represented by $R_4$ are a methyl group, ethyl group, vinyl group, allyl group, propynyl group, benzyl group, acetyl group, propionyl group, acryloyl group, methacryloyl group and crotonoyl group.

$R_5$ represents a hydrogen atom or an alkyl group. As the alkyl group a methyl group is preferable.

Y represents —O— or

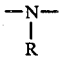

group, wherein R represents a hydrogen atom, alkyl group or acyl group.

$R_6$ represents an l-valent organic group, where l represents an integer, 1–4.

The typical compounds expressed by the formula [II] are as follows. However, the present invention is not limited only to these examples.

(II-1)

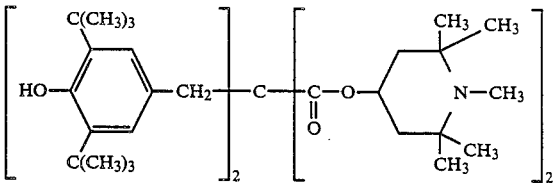

(II-2)

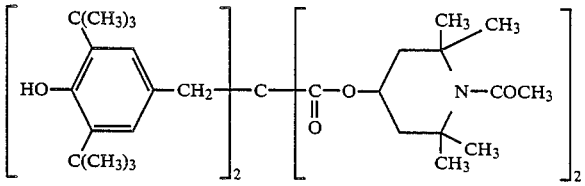

(II-3)

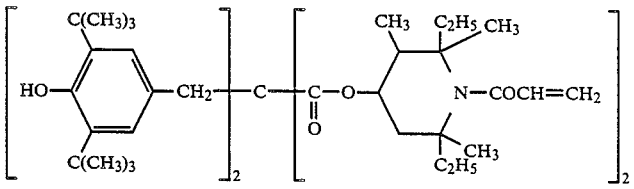

(II-4)

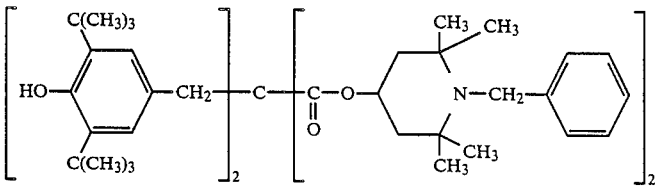

-continued
(II-5)
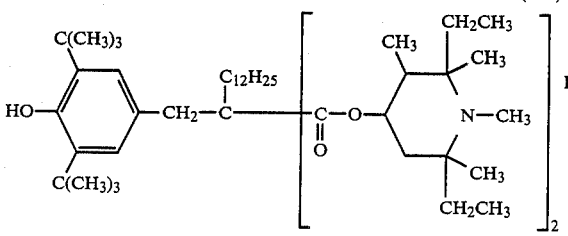
(II-6)
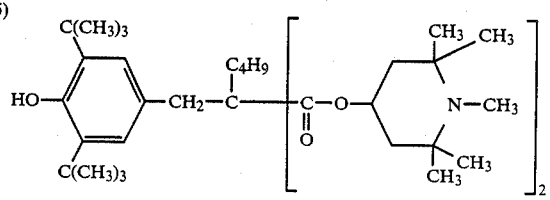
(II-7)
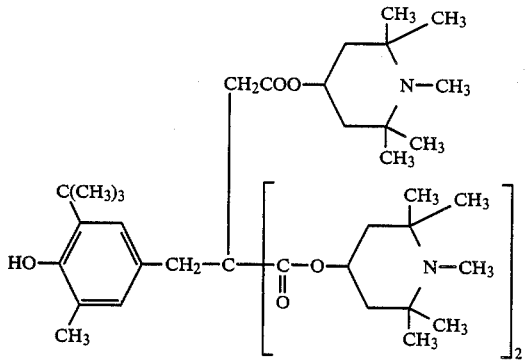
(II-8)
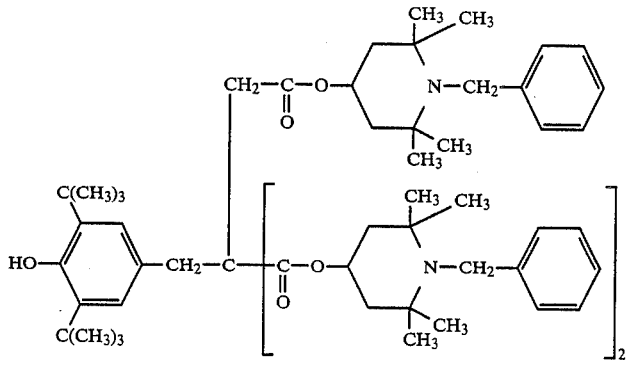
(II-9)
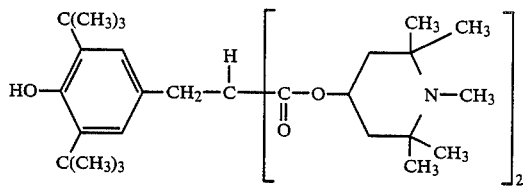
(II-10)
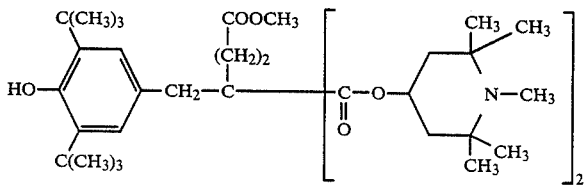

-continued
(II-11)
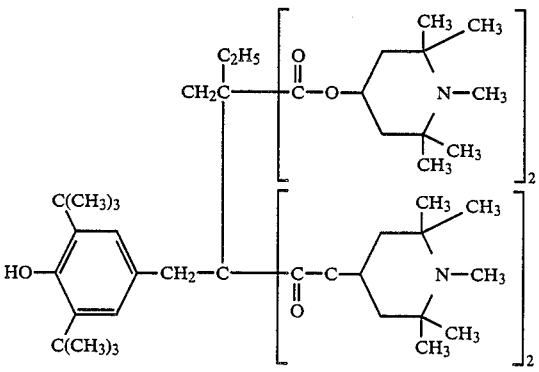
(II-12)
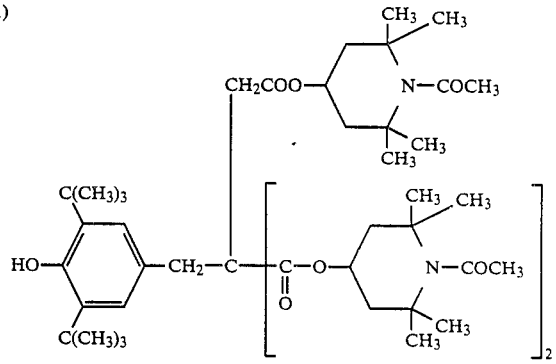
(II-13)
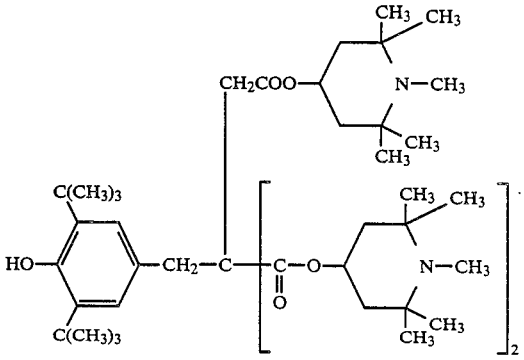
(II-14)
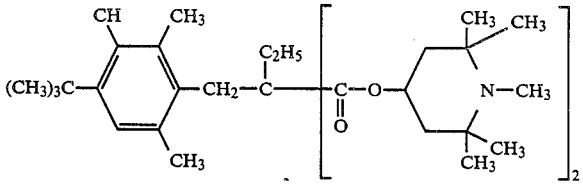
(II-15)
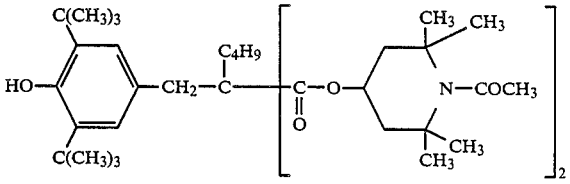
(II-16)
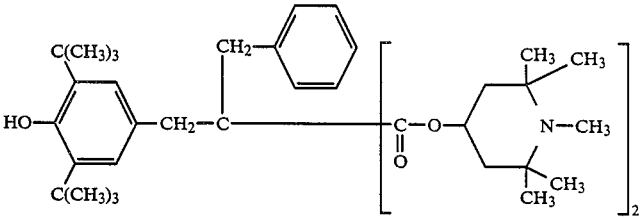
(II-17)
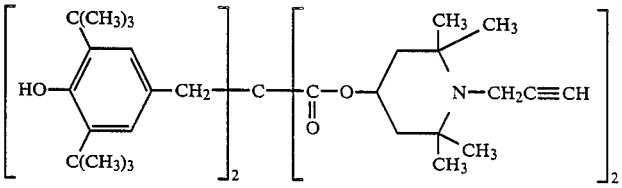

-continued
(II-18)
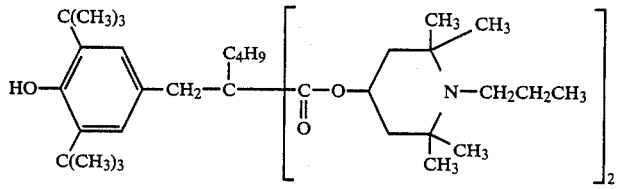
(II-19)
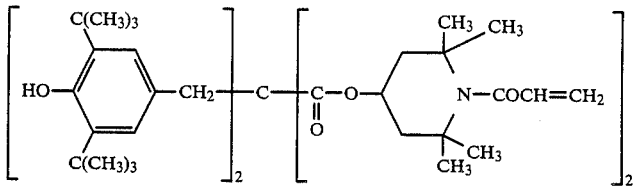
(II-20)
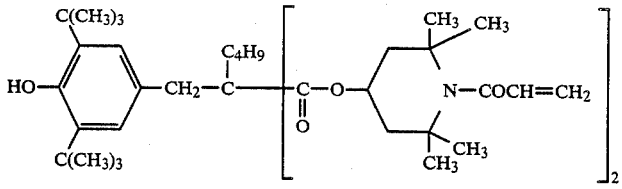
(II-21)
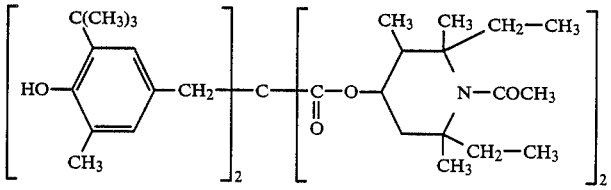
(II-22)
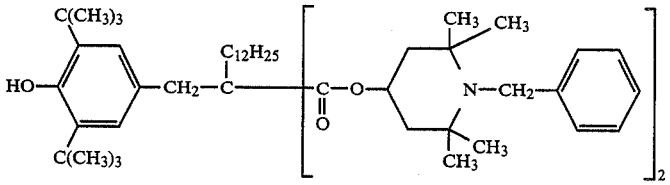
(II-23)
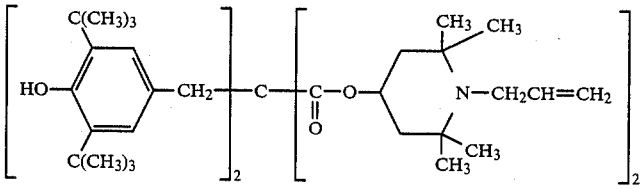
(II-24)
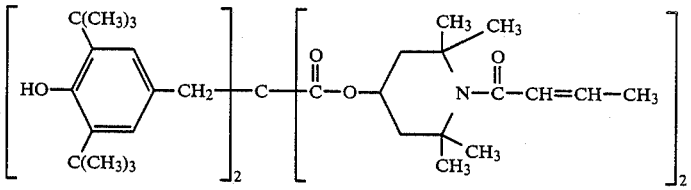
(II-25)
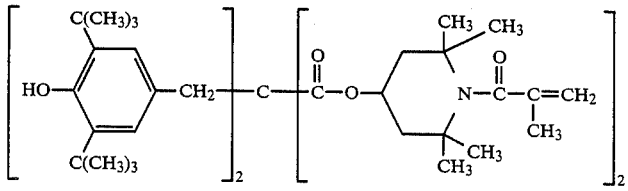

-continued
(II-26)
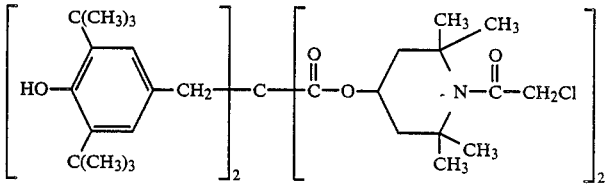
(II-27)
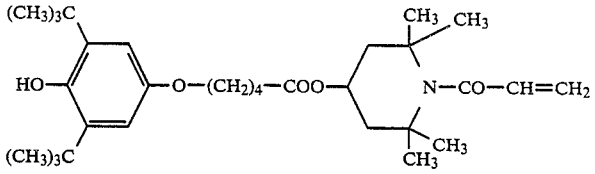
(II-28)
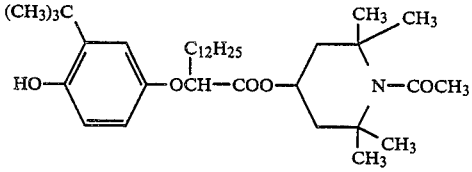
(II-29)
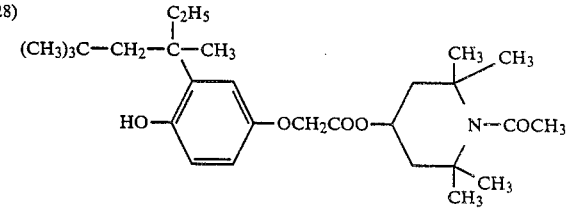
(II-30)
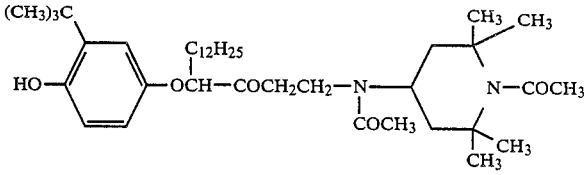
(II-31)
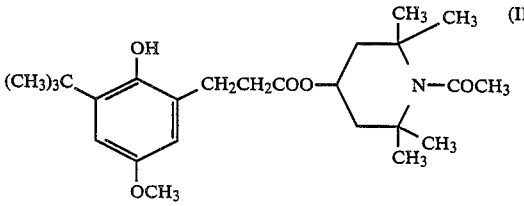
(II-32)
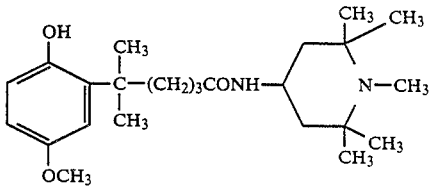
(II-33)
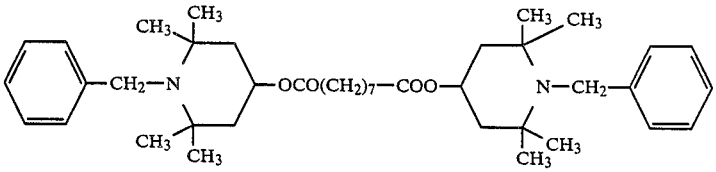
(II-34)
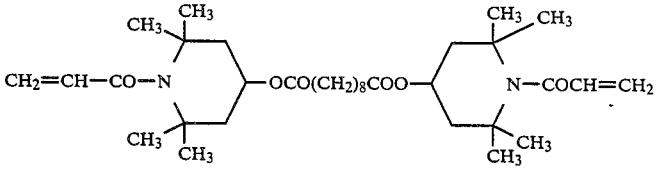
(II-35)
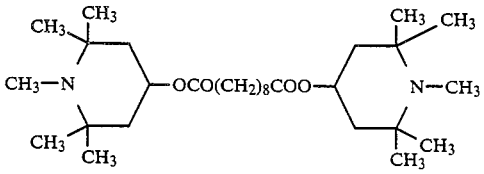

-continued

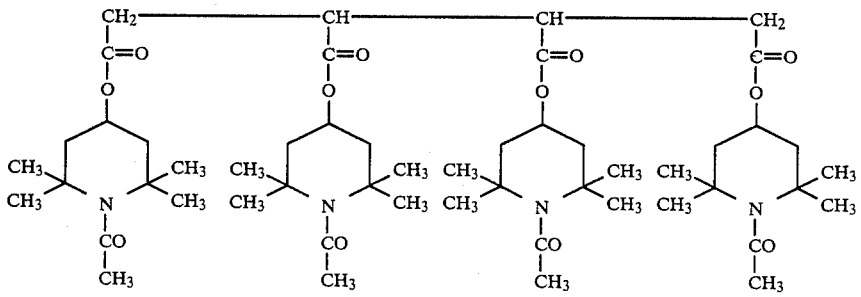

(II-36)

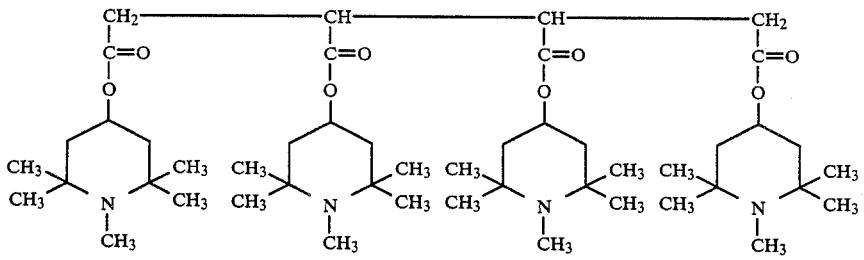

(II-37)

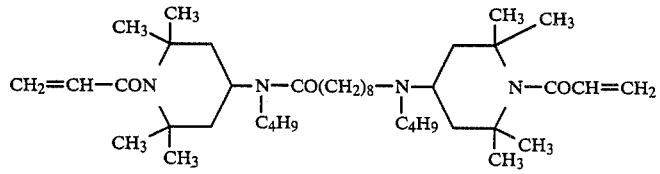

(II-38)

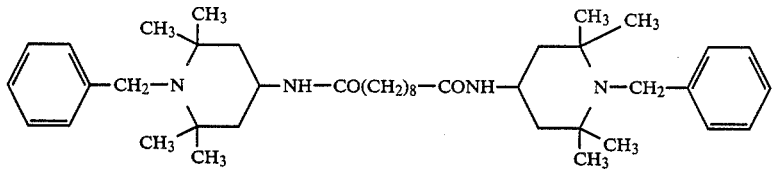

(II-39)

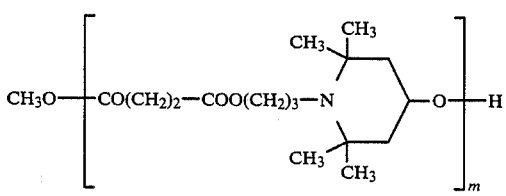

(II-40)

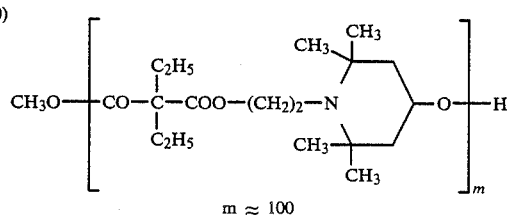

(II-41)

m ≈ 100

A compound expressed by the above-mentioned formula [I] or [II] is especially effective in enhancing the operation of the present invention when incorporated into the yellow-dye-image-forming layer or cyan-dye-image-forming layer.

The compounds expressed by the above-mentioned formula [I] or [II] can be incorporated into the silver halide emulsion layer at the rate of 5–100 weight percent, and, prerferably, 10–50 weight percent to the amount of the cyan or yellow coupler.

In the light-sensitive material of the invention, the most favorably used yellow-dye-image-forming couplers are those expressed by the formula [III], below.

Formula [III]

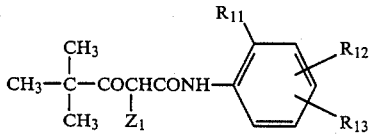

wherein, $R_{11}$ represents a halogen atom or an alkoxy group. R represents a hydrogen atom, a halogen atom or an alkoxy group which may have a substituent. $R_{13}$ represents an acylamino group, alkoxycarbonyl group, alkylsulfamoyl group, arylsulfamoyl group, arylsulfonamido group, alkylureido group, arylureido group, succinimido group, alkoxy group or aryloxy group, each of which may have a substituent. $Z_1$ is a group capable of being splitted off upon the coupling reaction with the oxidized product of the color developing agent.

The exemplications of a bivalent yellow coupler advantageously used in the present invention are as follows.
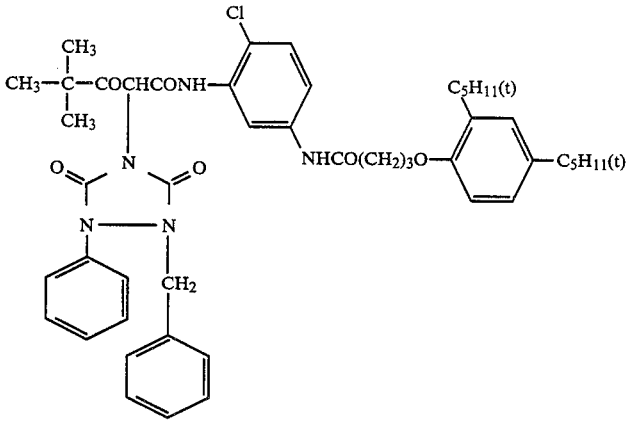
(Y-1)
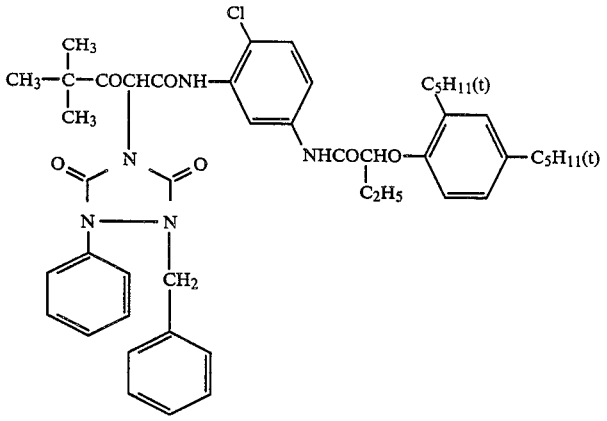
(Y-2)
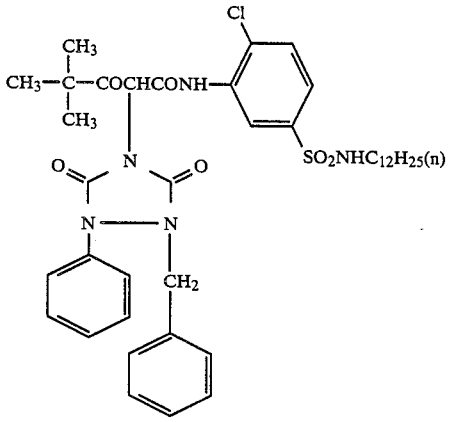
(Y-3)

-continued
(Y-4)
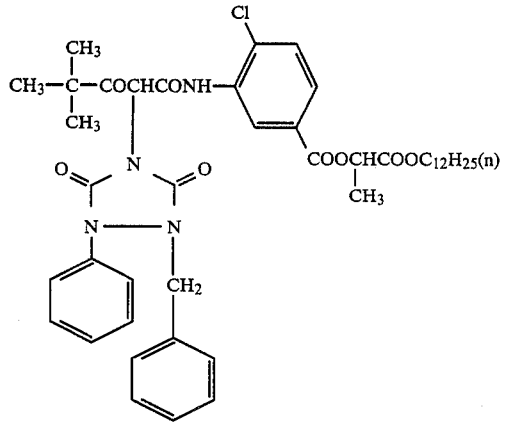
(Y-5)
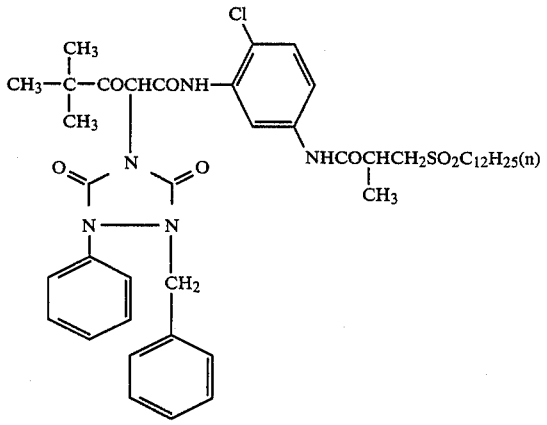
(Y-6)
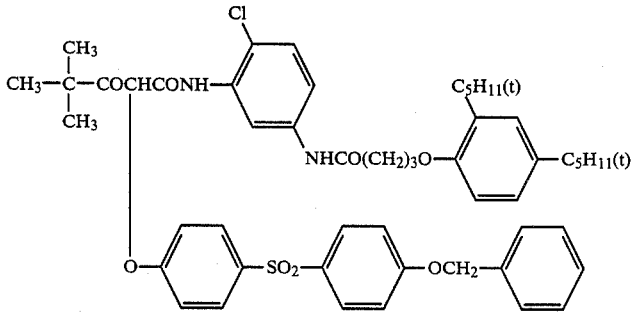
(Y-7)
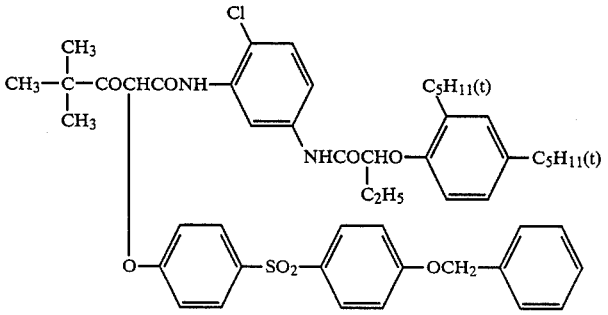

-continued
(Y-8)
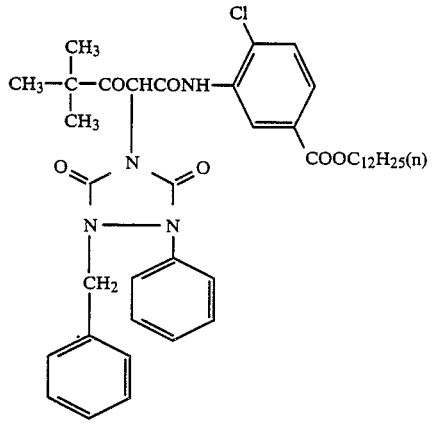
(Y-9)
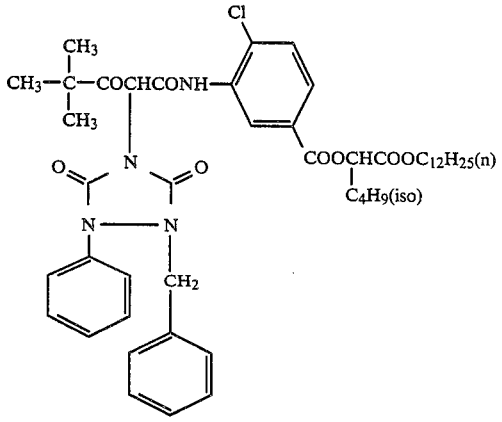
(Y-10)
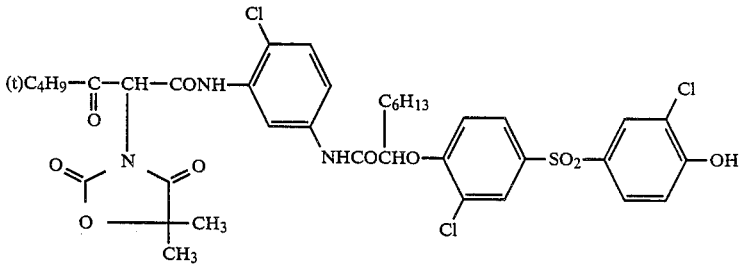
(Y-11)
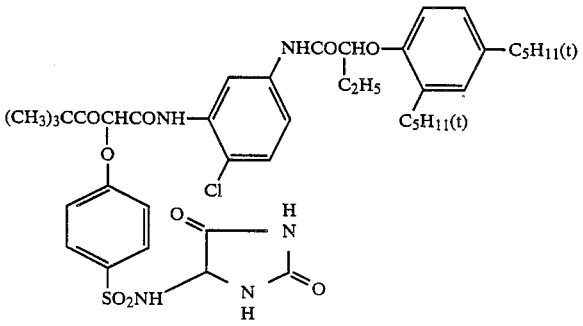

-continued
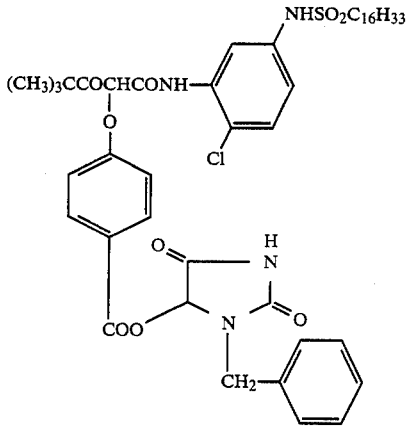
(Y-12)
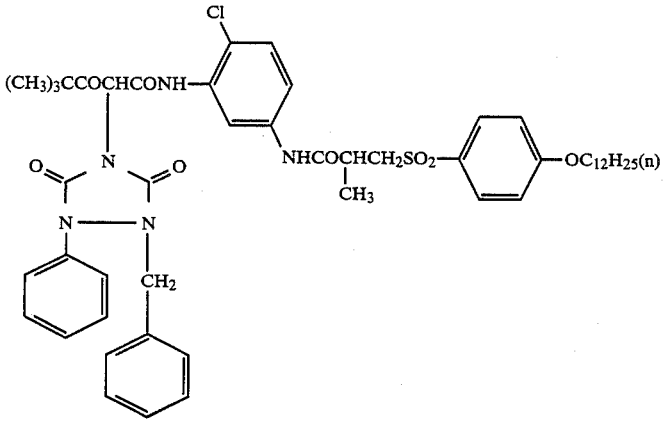
(Y-13)
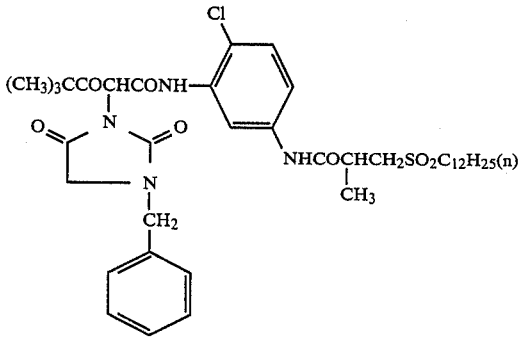
(Y-14)
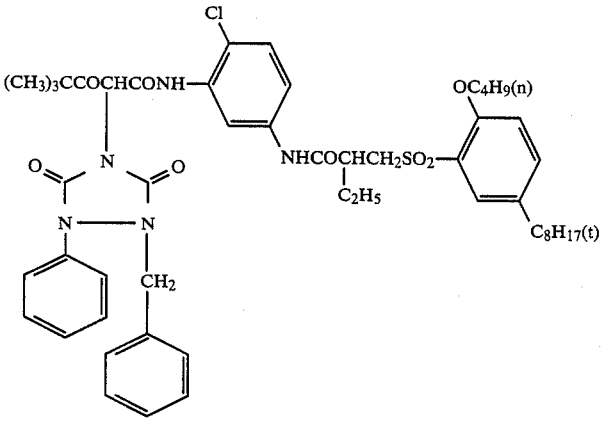
(Y-15)

-continued
(Y-16)
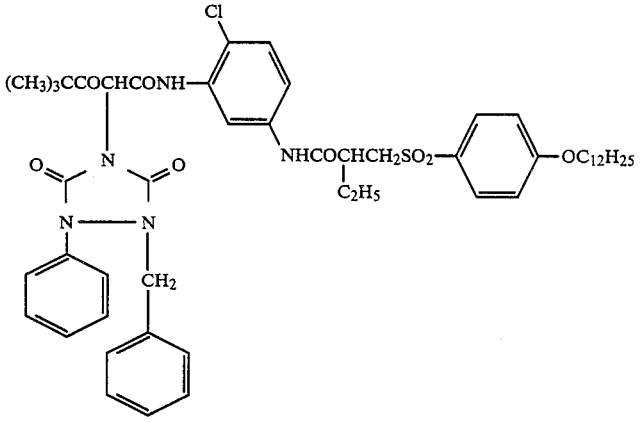
(Y-17)
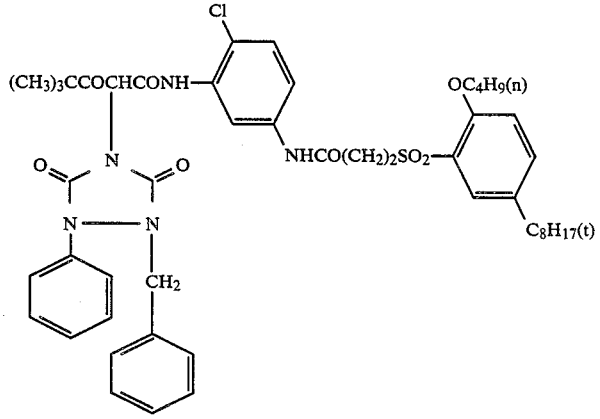
(Y-18)
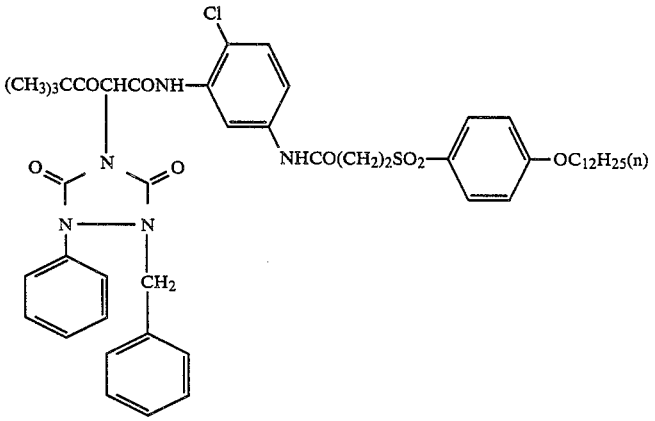
(Y-19)
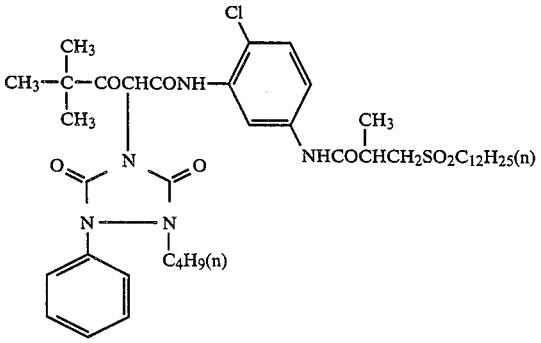

-continued
(Y-20)
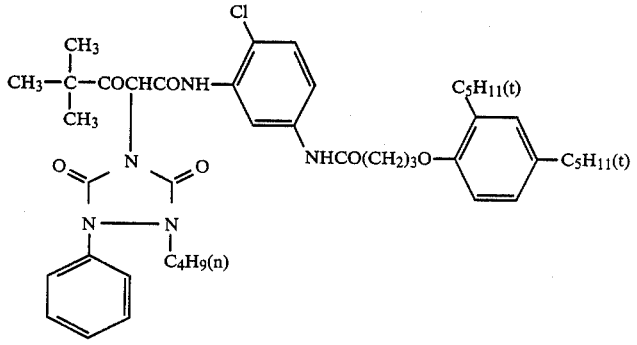
(Y-21)
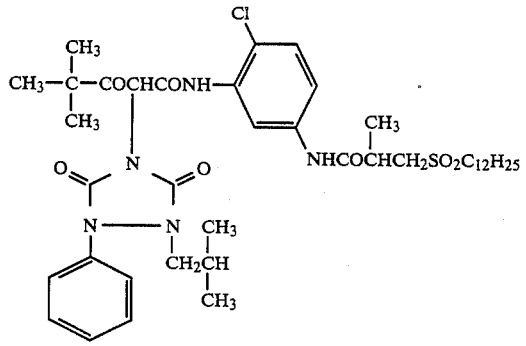
(Y-22)
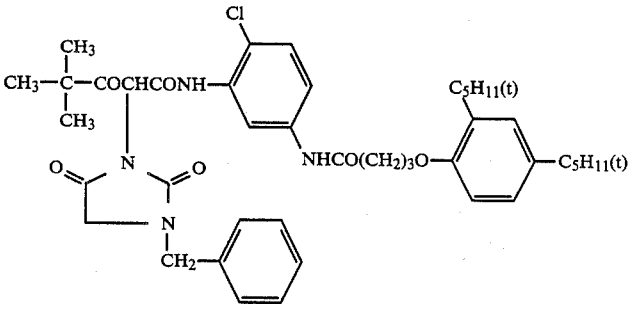
(Y-23)
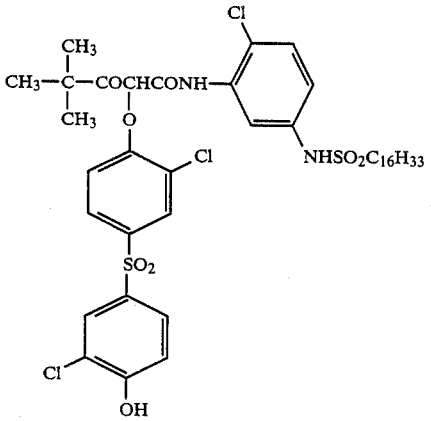

-continued
(Y-24)
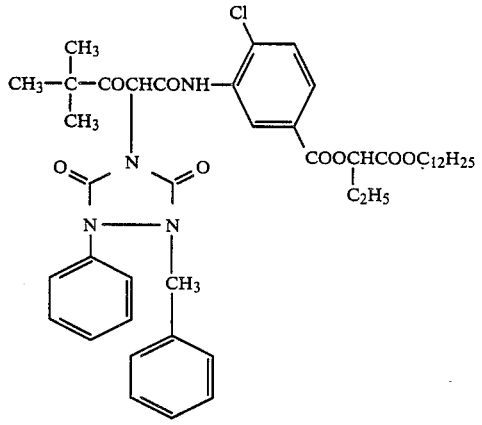
(Y-25)
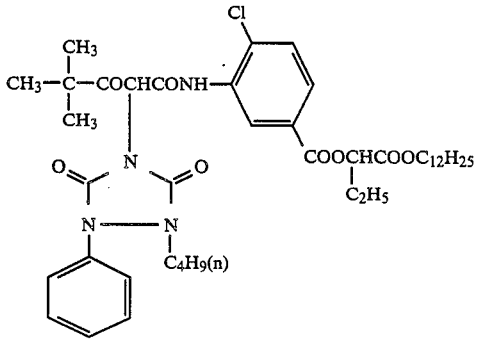
(Y-26)
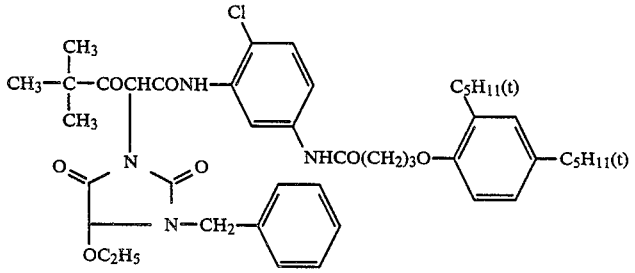
(Y-27)
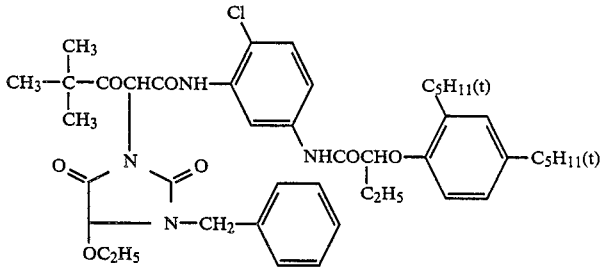
(Y-28)
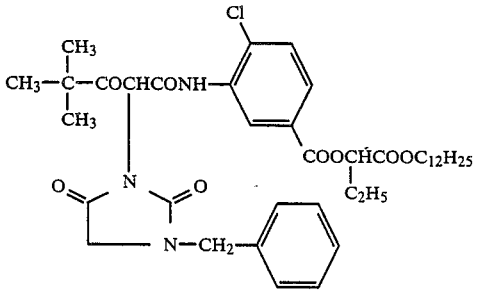

-continued (Y-29)

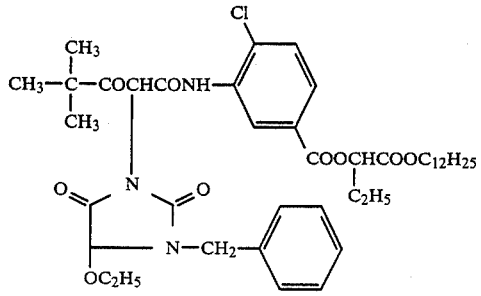

(Y-30)

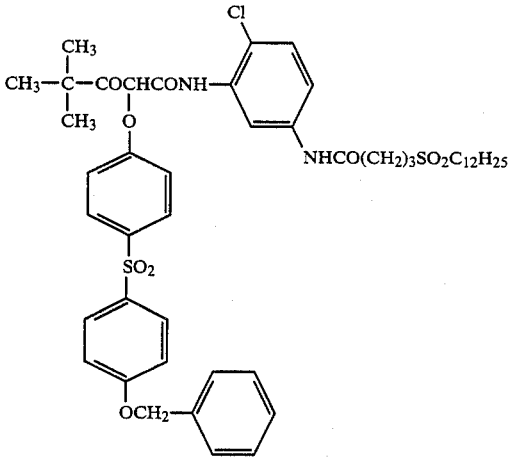

(Y-31)

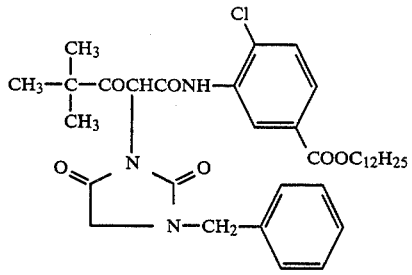

The cyan coupler incorporated into the cyan-dye-forming silver halide emulsion layer in the light-sensitive material of the invention is favorably the one represented by the following formula [IV] or [V].

Formula [IV]

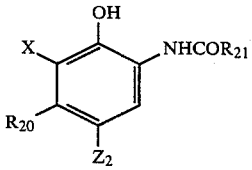

wherein, X represents a halogen atom. $R_{20}$ represents an alkyl group which has 1–6 carbon atoms and may possess a substituent. $R_{21}$ is ballast group. $Z_2$ is a group capable of being splitted off upon the reaction with a hydrogen atom or the oxidized product of the color developing agent.

Formula [V]

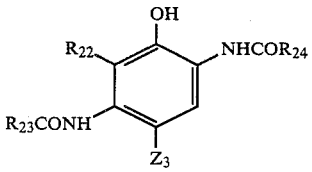

wherein, $R_{22}$ represents a hydrogen atom, halogen atom, alkoxy group, alkyl group or a group of atoms necessary to complete a six membered ring together with $R_{23}$. $R_{23}$ represents an alkyl group or aryl group. $R_{24}$ represents an alkyl group, cycloalkyl group, aryl group, $NHR_{25}$ (where, $R_{25}$ represents an alkyl group or aryl group) or heterocyclic group. $Z_3$ is the same as $Z_2$ in the formula [IV].

Next, the exemplifications of a cyan coupler represented by the formula [IV] are as follows.

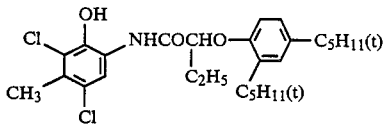
(IV-1)
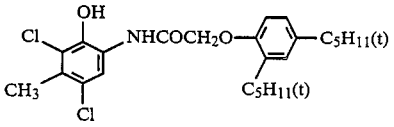
(IV-2)
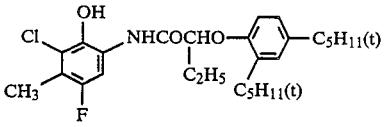
(IV-3)
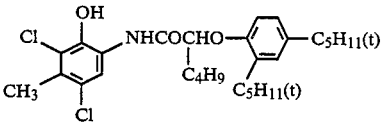
(IV-4)
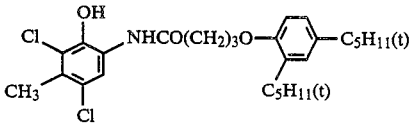
(IV-5)
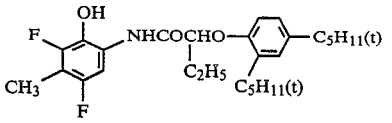
(IV-6)
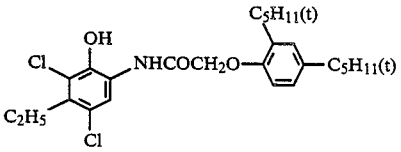
(IV-7)
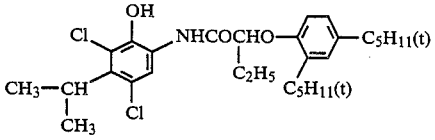
(IV-8)
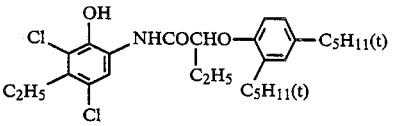
(IV-9)
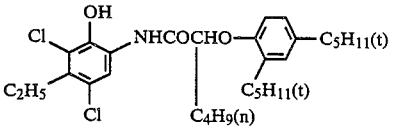
(IV-10)
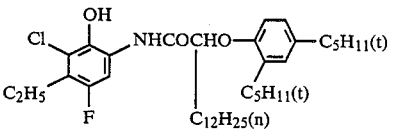
(IV-11)
-continued
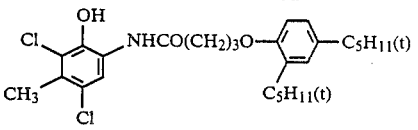
(IV-12)
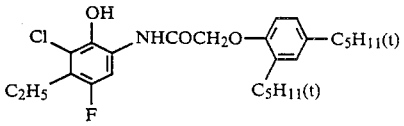
(IV-13)
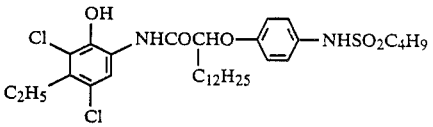
(IV-14)
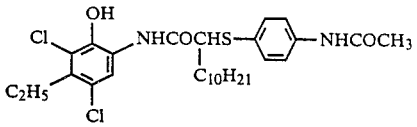
(IV-15)
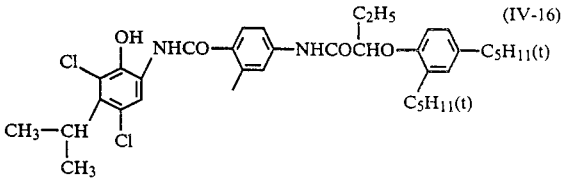
(IV-16)
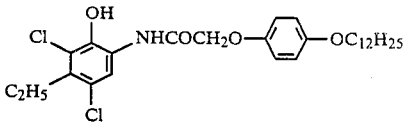
(IV-17)
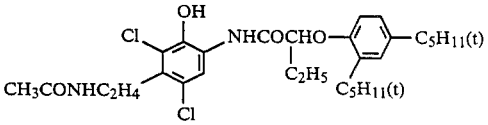
(IV-18)
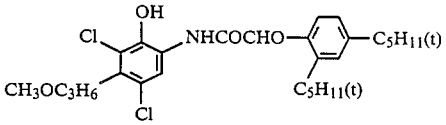
(IV-19)
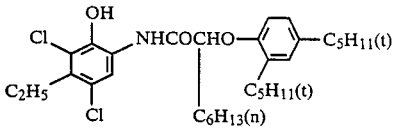
(IV-20)
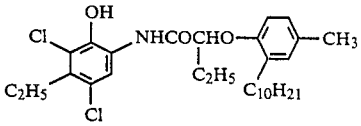
(IV-21)
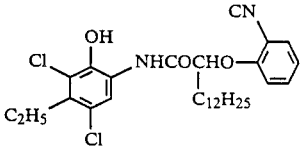
(IV-22)

-continued
(IV-23)
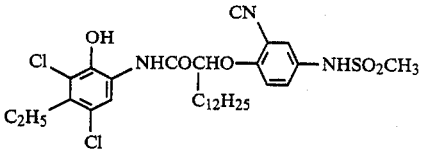
The exemplifications of a cyan coupler represented by the formula [V] are as follows.
(V-1)
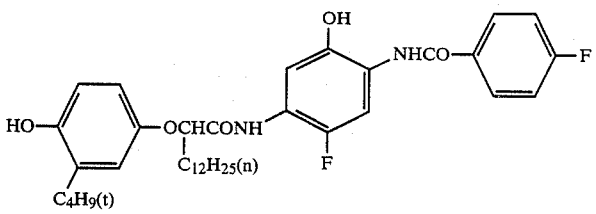
(V-2)
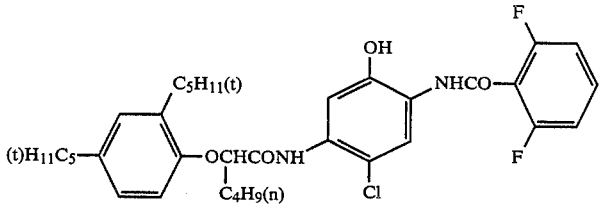
(V-3)
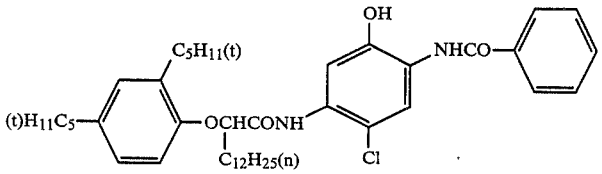
(V-4)
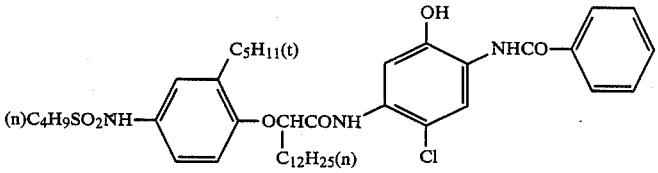
(V-5)
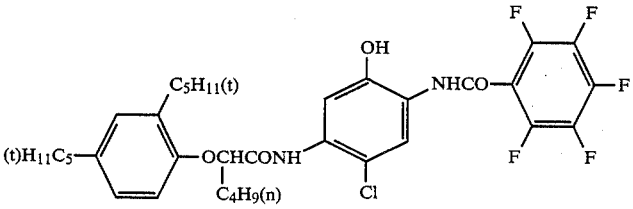
(V-6)
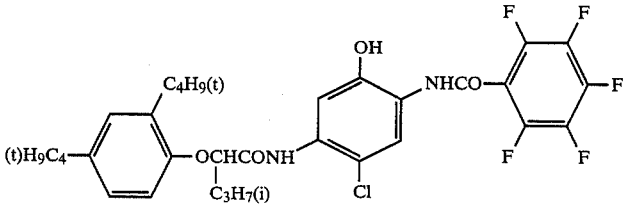
(V-7)
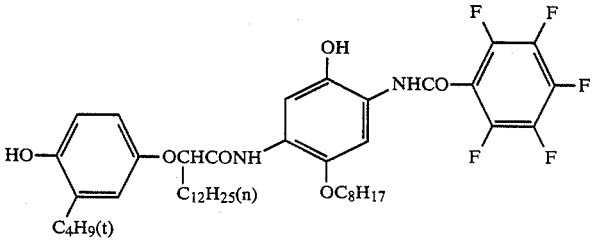

-continued
(V-8)
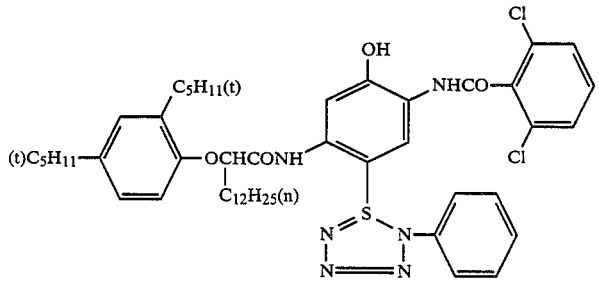
(V-9)
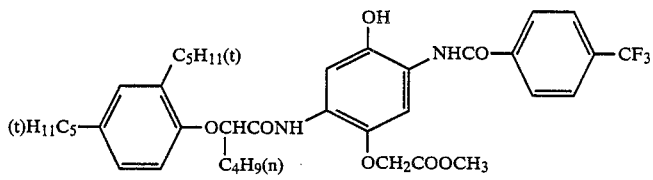
(V-10)
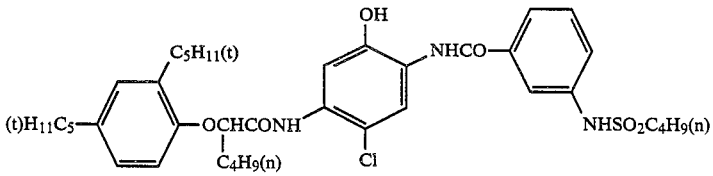
(V-11)
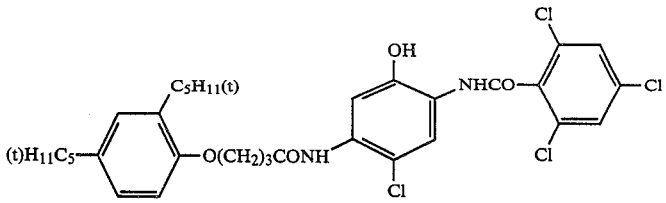
(V-12)
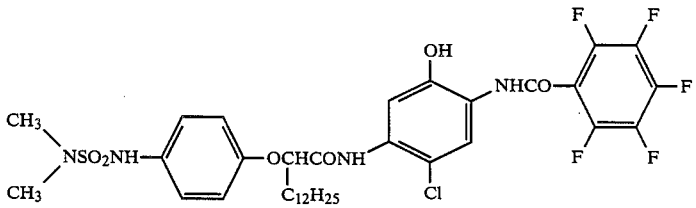
(V-13)
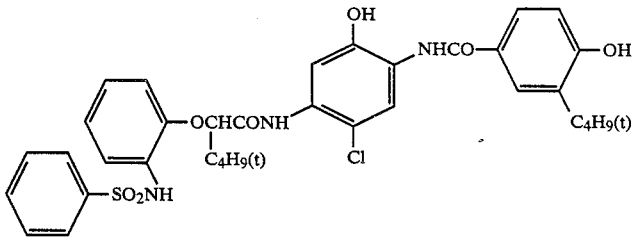
(V-14)
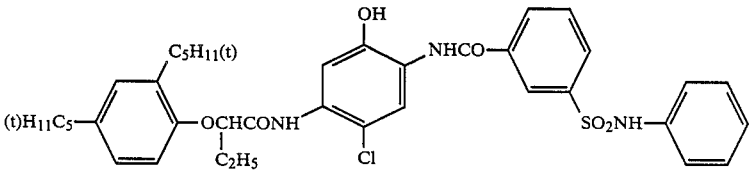

-continued
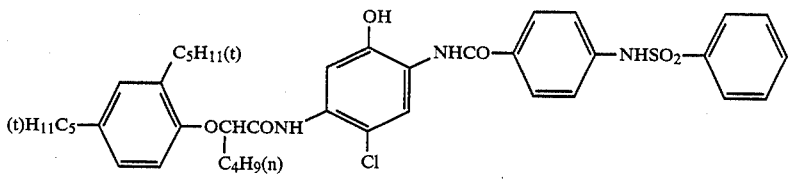
(V-15)
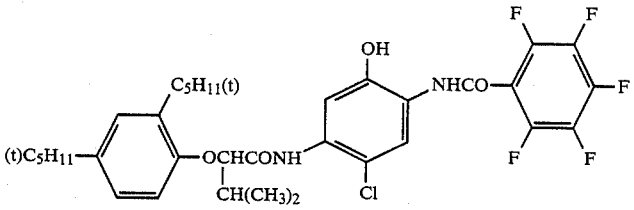
(V-16)
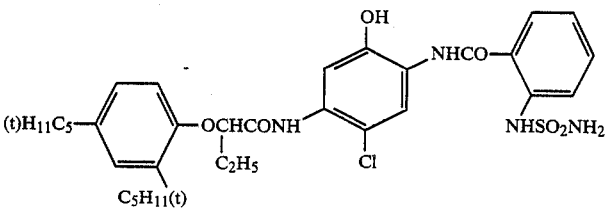
(V-17)
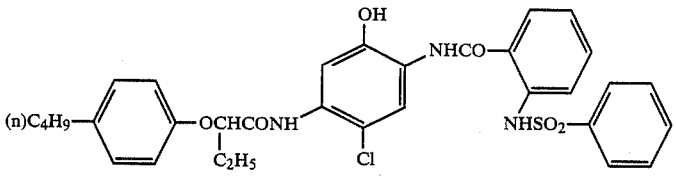
(V-18)
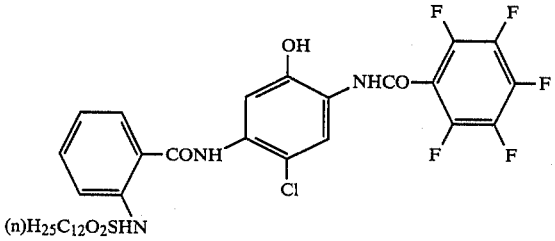
(V-19)
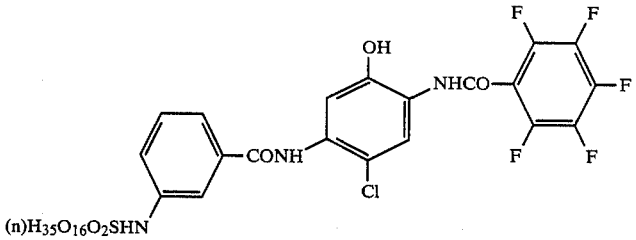
(V-20)
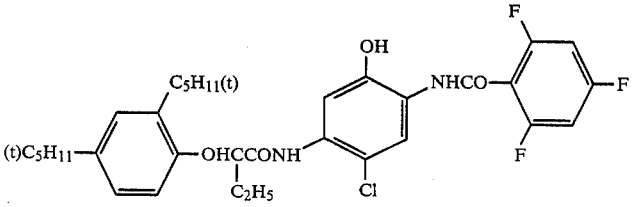
(V-21)

-continued (V-22)

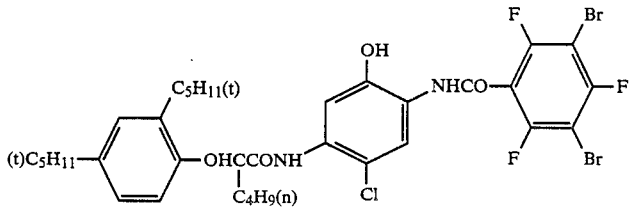

(V-23)

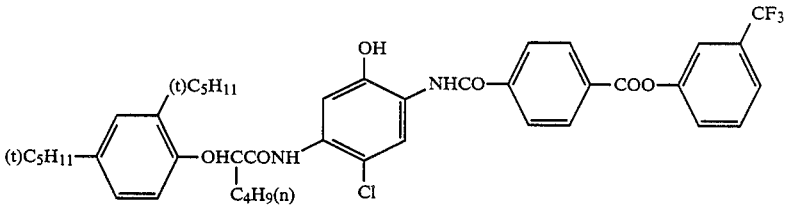

(V-24)

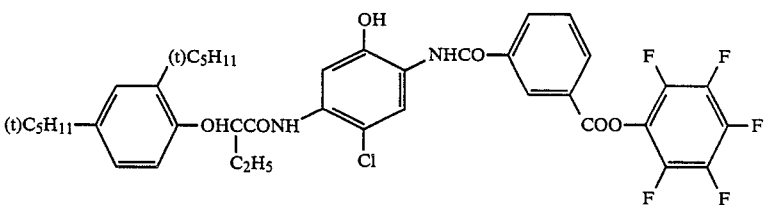

(V-25)

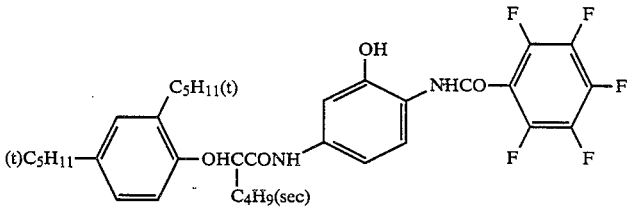

(V-26)

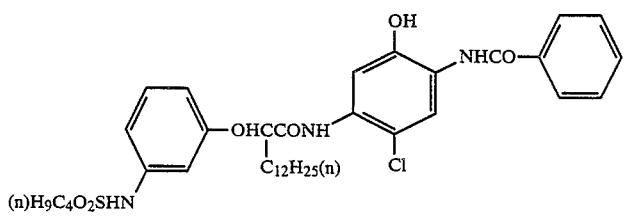

(V-27)

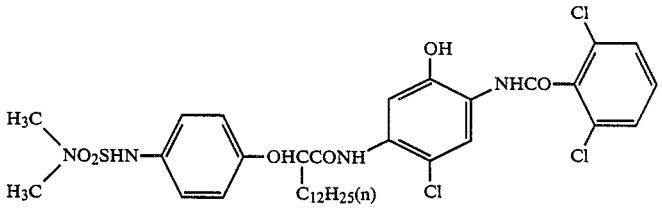

(V-28)

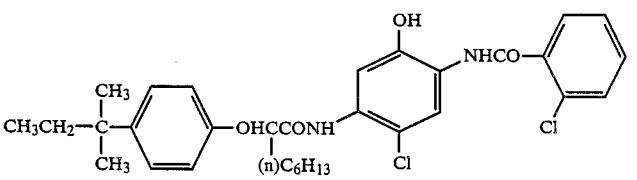

Each of the yellow coupler represented by the above-mentioned formula [III] and the cyan coupler represente either by the formula [IV] or [V] is used at the rate of approximately 0.05–2 mol, or, more favorably, 0.1–0.7 mol per mol silver halide.

When adding the compound expressed by the above-mentioned formula [I] or [II] as well as a cyan coupler or yellow coupler into the light-sensitive material, the blending is carried out, preferably by dissolving them into a high-boiling organic solvent which is immiscible with water and has boiling point higher than about 170° C., and by emulsificating this solvent into a hydrophilic colloid through dispersion.

The high-boiling organic solvents used for such a purpose include, for example, a phthalic ester such as dimethylphthalate, dibutylphthalate, dioctylphthalate, diallylphthalate, dinonylphthalate, dilaurylphthalate, dibenzylphthalate, diphenylphthalate and the like, a phosphoric ester such as diphenylphosphate, tricresylphosphate, triphenylphosphate, dioctylbutylphosphate, trihexylphosphate, trioctylphosphate and the like, a citric ester such as tributylacetyl citrate, tributyl citrate and the like, a benzoic ester such as butyl benzoate, octyl benzoate and the like, an alkyl amide such as diethyllaurylamide and the like, a sebacic ester such as diethylhexyl sebacate and the like, a stearic ester such as butyl stearate and the like, a maleic ester such as dinonyl maleate and the like, a succunic ester such as diethyl succinate and the like, an adipic ester such as dioctyl adipate and the like, a pyrolidone such as N-dodecylpirolidone and the like and others.

The examples of a low-boiling approx. 30°-150° C. organic solvent used as a auxiliary solvent combinedly with such a high-boiling organic solvent include a lower acetylacetate ethyl acetate, butyl acetate, beta-ethoxyethylacetate and the like, butyl alcohol, methylisobutylketone, chloroform, hexane, cyclohexane, ethyleneglycol, acetone, ethanol, dioxane, dimethylformamide and the like.

To obtain a dye-image with the light-sensitive material according to the invetion, the color developing is carried out after exposure. The color developing is a process to form a color dye-image, and more specifically is a process where the oxidized product of the color developing agent reacts with the color coupler to form a color dye-image.

The color developing agent contained in the color developer is an aromatic primary amine color developing agent, and the examples of which include aminophenol series and p-phenylenediamine series derivatives. Among these, the p-phenylenediamine serires derivatives are preferable. These color developing agents can be used in the form of salts of organic acids and inorganic acids, and a hydrochloride, sulfate, p-toluenesulfonate, sulfite, oxalate, benzenesulfonate and the like can be used.

These compounds should be usually used at the rate of about 0.1-30 g, and more favorably, approximately 1-20 g, per 1 liter color developer. An addition, less than 0.1 g per 1 liter color developer, cannot provide satisfactory density of color image.

Additionally, the treatment is carried out in a color developer bath whose treating solution has a temperature range of 10°-65° C., or more fovorably, 25°-45° C.

The especially useful primary amine series color developers are N-N-dialkyl-p-phenylenediamine series compounds, whose alkyl group and phenyl group may have or may not contain a substituent. The examples of by far useful compounds include N-N-dimethyl-p phenylenediamine hydrochloride, N-methyl-p-phenylenediamine hydrochloride, N,N-dimethyl-p-phenylenediamine hydrochloride, 2-amino-5-(N-ethyl-N-dodecylamino)-toluene, N-ethyl-N-beta-methanesulfonamideethyl-3-methyl-4-aminoaniline sulfate, N-ethyl-N-beta-hydroxyethylaminoaniline, 4-amino-3-methyl-N,Ndiethylaniline, 4-amino-N-(2-methoxyethyl)-N-ethyl-3-methylanilinep-toluenesulfonate and others.

Any of the developing agents, above, can be independently used, or more than two of them can be combinedly used.

The N,N-dialkylhydroxylamine series compound used in the invention are preferably the compounds expressed by the following formula [VI] and the water-soluble acid salts thereof.

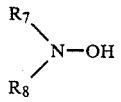

Formula [VI]

wherein, $R_7$ and $R_8$ independently represent an alkyl group. An alkyl group having 1-4 carbon atoms (methyl group, ethyl group, n-propyl group, n-butyl group and others) is especially favorable.

As a water-soluble acid used to form a salt together with a compound expressed by the formula [VI], above, sulfuric acid, hydrochloric acid, phosphoric acid, carbonic acid, acetic acid and oxalic acid are preferable.

The examples of the compound expressed by the formula [VI] include N,N-dimethylhydroxylamine, N,N-diethylhydroxdylamine, N,N-dipropylhydroxylamine and N,N-dibutylhydoxylamine. These N,N-dialkylhydroxylamine salts are used at the rate of 0.2-15 g, and preferably, 0.5-10 g per 1 liter color developer. Additionally, the N,N-dialkylhydroxylamine salts may be used combinedly with hydroxylamine salts, as far as such use does not spoil the operation of the invention. However, the addition of hydroxylamine is preferably within the range of less than 1 g, or, more favorably, less than 0.5 g per 1 liter color developer (with $NH_2OH.\frac{1}{2}H2SO_4$).

When incorporating N,N-dialkylhydroxylamine into the lightsensitive material and replenishing it into color developer during continuous tratment of the material, N,N-dialkylhydoxylamine is used at the rate of approximately 0.05-5 g, or preferably, 0.1-2 g per 1 $m^2$ light-sensitive material.

The color developer used in the invention may contain alkali agents, usually used in a developer, including alkali agents and pH buffer agents, such as sodium hydoxide, potassium hydroxide, ammonium hydroxide, sodium carbonate, potassium carbonate, trisodium phosphate, sodium dihydrogenphosphate, sodium monohydrogenphosphate, potassium monohydrogenphosphate, sodium metaborate, borax and the like, and may incorporate still other additives.

The examples of such additives include organic solvents such as methanol, ethanol, ethylene glycol, diethylene glycol, triethanolamine, acetone, N-dimethylformamide, diethylene glycol, monobutyletheracetate and the like, alkali halides such as lithium chloride, sodium chloride, potassium chloride, sodium bromide, potassium bromide and the like, development control agents such as citrazinic acid and the like, defoaming agents, surface active agents such as nonion surface active agents and anion surface active agents, fluorescent whitening agents and chelating agents.

Incorporating a sulfite as a preservative into the color developer of the invention, in addition to the N,N-dialkylhydroxylamine or watersoluble salt thereof, is advantageous to the improved shelf-life of the color developer of the invention. As the sulfite for such a purpose, sodium sulfite and potassium sulfite are most commonly used. Such sulfites are used at the rate of 0.2–6 g per 1 liter color developer.

Furthermore, with the method for forming dye-image according to the invention, it is possible to allow a 1-aryl-3-pyrazolidone series compound being present during the color developing, in order to accelerate color developing. Such 1-aryl-3-pyrazolidone series compound may be incorporated into the light-sensitive material in advance, or may be incorporated into the color developer. However, the operation of the present invention, that is, an operation whereby through the accelerated treatment a dye-image having a high maximum density, especially a dye-image of the invention having both a high maximum density and high light fastness, is best achieved by incorporating a 1-aryl-3-pyrazolidone series compound into the color developer.

The examples of the 1-aryl-3-pyrazolidone series compound used in the invention are as follows.

[Example Compounds]

AP - 1 1-phenyl-3-pyrazolidone
AP - 2 4-methyl-4-hydroxylmethyl-1-phenyl-3-pyrazolidone
AP - 3 4,4-dimethyl-1-phenyl-3-pyrazolidone
AP - 4 4-methyl-4-hydroxylmethyl-1-(p-tolyl)-3-pyrazolidone
AP - 5 4-methyl-4-acetoxymethyl-1-phenyl-3-pyrazolidone
AP - 6 4-methyl-1-phenyl-3-pyrazolidone
AP - 7 4,4-dihydroxylmethyl-1-phenyl-3-pyrazolidone
AP - 8 4-methyl-4-hydroxylethyl-1-penyl-3-pyrazolidone
AP - 9 4-methyl-4-i-butyloyloxymethyl-1-phenyl-3-pyrazolidone After the dye-image is formed by color develing, the remaining developed silver as well as the undeveloped silver halide are removed from the light-sensitive material preferably by treating it with bleach-fixer.

With the silver halide color photographic light-sensitive material a treating temperature for each treating process, such as color developing and bleach-fixing or bleaching and fixing, and for treating process carried out in accordance with requirements such as water-washing, stablization, drying or the like, is more than 25° C., or preferably more than 30° C., in view of the accelerated treatment.

The silver halide photographic light-sensitive material of the invention may be subjected to the stabilizing treatment without water washing described in Japanese Patent O.P.I. Publications No. 14834 1983, No. 105145/1983, No. 134634/1983 and No. 18631/1983, and Japanese patent applications No. 2709/1983 and No. 89288/1984, and others.

EXAMPLES

The typical examples of the present invention are described as follows. However, the scope of embodiment of the invention is not limited only to these examples.

EXAMPLE - 1

With a 170 g/m$^2$ paper support having laminated polyethylene on one side thereof, and laminated polyethylene containig 11 weight % of anatase-type titanium dioxide on the other side thereof, the following layers were sequentially disposed through coating on the side which has polyethylene involving titanium dioxide so as to prepare silver halide color photographic light-sensitive materials 1–26. The amounts of addition are, unless otherwise specified, denoted by the amount per 1 m$^2$ light-sensitive material.

Layer 1 . . . A layer containing 1.7 g gelatin and 0.35 g blue-sensitive silver-chloro bromide emulsion (the amount of silver means the converted value representing equivalent silver, and is applicable to all the following examples), and 0.4 g dinonylphthalate (DNP) into which yellow coupler ($1.3\times10^{-3}$ mol) in Table - 1, light stablizer (0.4 g) and 0.02 g anti-stain agent (HQ - 1) described later having been dissolved.

Layer 2 . . . A layer containing 1.5 g gelatin, and 0.4 g DNP into which 0.6 g ultraviolet-ray absorvent UV - 1, described as follows, having been dissolved.

Layer 3 . . . A layer containing 1.1 g gelatin and 0.042 g 2,4-dichloro6-hydroxy-s-triazinesodium (H - 1: hardener).

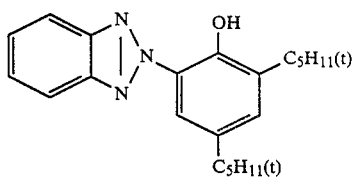

UV-1

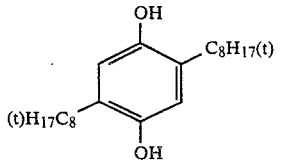

HQ-1

The light-sensitive materials 1–26, above, were exposed through an optical wedge, and treated according to the following processes.

| Processes | [A] | [B]-[F] |
|---|---|---|
| Color developing | Color developer [A] 38° C., 3 min | Color developers [B]-[F] 35° C., 1 min |
| Bleach-fixing | 33° C., 1 min | 33° C., 1 min |
| Water-rinsing | 30–34° C., 1 min | 30–34° C., 1 min |
| Drying | 60–80° C., 1 min | 60–80° C., 1 min |

The composition of each treating solution is as follows (per 1 liter solution). Each color developer was used after it has been stored under a room temperature for two weeks after its preparation.

Color developer composition

| | (A) | (B)-(F) |
|---|---|---|
| Pure water | 800 ml | 800 ml |
| Triethanolamine | 15 ml | |
| Benzyl alcohol | 15 ml | |
| Preservative (*1) | 3 g | 3 g |
| Potassium bromide | 1.2 g | 0.6 g |
| Sodium chloride | 0.3 g | 0.3 g |
| Potassium sulfite | 2.0 g | 2.0 g |
| Color developing agent (*2) | 4.5 g | 8 g |
| Potassium carbonate | 2.5 g | 2.5 g |
| Nitrilotrimethylenephosphoric acid | 2 g | 2 g |
| Water was poured to prepare 1 l solution, then pH was adjusted. | 10.1 | 11.6 |

(*1) Preservative

-continued

| Color developer composition |
|---|
| [A] Hydroxylamine sulfate.½ sulfate |
| [B] (H.A.S.) |
| [C] N,N—diethylhydroxylamine |
| [D] N,N—dimethylhydroxylamine |
| [E] D-glucoseamine hydrochloride (Compound described in Japanese Patent O.P.I. Publication No. 89425/1978) |
| [F] Does not contain |
| (*2) Color developing agent N—ethyl-N—methanesulfonamideethyl-3-methyl-4-aminoaniline sulfate |

Bleach-fixer composition

| | |
|---|---|
| Pure water | 600 ml |
| Ammonium ferric [III] ethylenediaminetetraacetate | 65 g |
| Disodium ethylenediaminetetraacetate | 5 g |
| Ammonium thiosulfate | 85 g |
| Sodium bisulfite | 10 g |
| Sodium metabisulfite | 2 g |
| Sodium bromide | 10 g |
| Color developer A | 200 ml |

Pure water was poured to prepare 1 liter solution, which was treated with dilute sulfuric acid to have the pH of 7.0.

The resultant samples were subjected to the reflecting density measurement with monochromatic blue light. The maximum density (DM) and gradation (the inclination correspounding with the reflecting density of 0.5 and 1.5 of the characteristic curve) of each sample were determined based on the obtained characteristic curve. The results are shown in Table - 1.

Also, in order to examine the light-fading properties, each sample was irradiated with a fademeter (manufactured by Suga Shikenki Co., Ltd.) for 240 hours, whereby the dyeimage residual rate relative to the initial density of 1.0 was determined. The obtained results are also shown in Table - 1.

each sample was treated with a color developer not having benzyl alcohol within it and containing hydroxylamine or D-glucoseamine as a preservative, provided a dye-image having lower maximum density and gradataion, and that with these treatments the effect of a light stabilizer in terms of light fastness was insufficient. In contrast, it is apparent that the treatments ([C] and [D]), wherein N,N-dialkylhydroxylamine of the invention was incorporated into a color developer as a preservative, could provide a dye-image having higher maximum density and gradataion, as well as more improved light fading properties.

Also, it is apparent that the treatment ([F]), wherein a color developercontaining only potassium sulfite as a preservative, failed to provide a dye-image having sufficiently high maximum density as a result of two weeks of storage.

EXAMPLE - 2

The following layers were disposed on the reflective support also used in Example - 1 through coating so as to prepare the lightsensitive materials 27–41.

Layer 1 . . . A layer containing 1.6 g gelatin and 0.24 g red-sensitive silver chloro-bromide emulsion, and 0.3 g di-2-ethylhexylphthalate (DOP) into which $0.9\times10^{-3}$ mol of cyan coupler shown in Table - 3, 0.2 g light stabilizer and 0.01 g HQ - 1 having been dissolved.

Layer 2 . . . A layer containing 1.3 g gelatin, and 0.2 g DNP into which 0.4 g UV - 1 having been dissolved.

Layer 3 . . . A layer containing 1.0 g gelatin and 0.040 g AI - 1. The obtained samples were treated with color developers [A], [B], [C] and [D] in the same manner as Example - 1, then the maximum density, gradation and light-fasness were examined on each sample. The results are shown in Table -2.

TABLE 1

| Sample | Yellow | Light stabi- | Maximum density | | | | | | Gradation | | | | | | Dye-image residual rate | | | | | |
|---|---|---|---|---|---|---|---|---|---|---|---|---|---|---|---|---|---|---|---|---|
| No. | Coupler | lizer | [A] | [B] | [C] | [D] | [E] | [F] | [A] | [B] | [C] | [D] | [E] | [F] | [A] | [B] | [C] | [D] | [E] | [F] |
| 1 | Y-4 | — | 2.7 | 2.2 | 2.6 | 2.6 | 2.4 | 1.6 | 3.4 | 2.6 | 3.4 | 3.4 | 3.3 | 0.6 | 24 | 15 | 24 | 21 | 20 | 21 |
| 2 | Y-4 | I-33 | 2.6 | 2.0 | 2.5 | 2.5 | 2.3 | 1.2 | 3.2 | 2.0 | 3.1 | 3.2 | 3.0 | — | 46 | 31 | 47 | 45 | 33 | 30 |
| 3 | Y-4 | I-36 | 2.6 | 1.9 | 2.4 | 2.5 | 2.2 | 1.0 | 3.2 | 1.7 | 3.0 | 3.2 | 2.9 | — | 49 | 32 | 50 | 50 | 34 | — |
| 4 | Y-4 | II-19 | 2.7 | 1.9 | 2.4 | 2.4 | 2.2 | 1.1 | 3.1 | 1.6 | 3.1 | 3.1 | 2.9 | — | 52 | 27 | 49 | 49 | 30 | 27 |
| 5 | Y-4 | II-40 | 2.6 | 1.8 | 2.5 | 2.5 | 2.3 | 1.0 | 3.2 | 1.6 | 3.1 | 3.1 | 2.8 | — | 57 | 29 | 55 | 58 | 32 | — |
| 6 | Y-6 | — | 2.5 | 2.0 | 2.4 | 2.4 | 2.3 | 1.2 | 2.9 | 1.8 | 2.6 | 2.7 | 2.3 | — | 30 | 20 | 21 | 23 | 26 | 27 |
| 7 | Y-6 | I-33 | 2.4 | 1.6 | 2.4 | 2.4 | 2.3 | 0.9 | 2.8 | 1.0 | 2.5 | 2.7 | 2.2 | — | 49 | 34 | 48 | 47 | 35 | — |
| 8 | Y-6 | I-36 | 2.4 | 1.6 | 2.3 | 2.5 | 2.2 | 0.9 | 2.8 | 0.9 | 2.5 | 2.6 | 2.2 | — | 52 | 33 | 50 | 51 | 37 | — |
| 9 | Y-6 | II-19 | 2.4 | 1.5 | 2.3 | 2.5 | 2.2 | 0.8 | 2.7 | 0.5 | 2.6 | 2.6 | 2.1 | — | 59 | 36 | 55 | 53 | 36 | — |
| 10 | Y-8 | — | 2.6 | 1.9 | 2.3 | 2.4 | 2.3 | 1.0 | 2.9 | 1.2 | 2.3 | 2.2 | 1.9 | — | 20 | 11 | 11 | 10 | 13 | 15 |
| 11 | Y-8 | I-33 | 2.5 | 1.4 | 2.3 | 2.4 | 2.2 | 0.7 | 2.8 | — | 2.2 | 2.2 | 1.9 | — | 41 | 17 | 38 | 41 | 24 | — |
| 12 | Y-8 | I-36 | 2.5 | 1.3 | 2.3 | 2.3 | 2.2 | 0.6 | 2.7 | — | 2.3 | 2.1 | 1.8 | — | 43 | 16 | 37 | 40 | 23 | — |
| 13 | Y-8 | II-19 | 2.6 | 1.4 | 2.3 | 2.3 | 2.2 | 0.6 | 2.8 | — | 2.3 | 2.1 | 1.8 | — | 42 | 16 | 36 | 37 | 21 | — |
| 14 | Y-17 | — | 2.7 | 2.0 | 2.6 | 2.5 | 2.3 | 0.8 | 2.6 | 1.5 | 2.8 | 2.7 | 2.5 | — | 39 | 27 | 33 | 30 | 27 | 24 |
| 15 | Y-17 | I-4 | 2.6 | 1.3 | 2.5 | 2.5 | 2.3 | 0.6 | 2.7 | — | 2.7 | 2.7 | 2.4 | — | 74 | 39 | 69 | 70 | 47 | — |
| 16 | Y-17 | I-43 | 2.7 | 1.4 | 2.5 | 2.4 | 2.2 | 0.6 | 2.7 | — | 2.8 | 2.6 | 2.4 | — | 71 | 43 | 65 | 69 | 43 | — |
| 17 | Y-17 | II-20 | 2.6 | 1.4 | 2.5 | 2.5 | 2.1 | 0.5 | 2.6 | — | 2.9 | 2.7 | 2.4 | — | 76 | 40 | 72 | 74 | 45 | — |
| 18 | Y-17 | II-39 | 2.6 | 1.4 | 2.5 | 2.4 | 2.1 | 0.6 | 2.6 | — | 2.8 | 2.7 | 2.5 | — | 77 | 44 | 70 | 76 | 45 | — |
| 19 | Y-19 | — | 2.6 | 2.1 | 2.5 | 2.4 | 2.2 | 1.3 | 2.9 | 2.0 | 2.7 | 2.6 | 2.3 | — | 33 | 29 | 27 | 26 | 24 | 23 |
| 20 | Y-19 | I-7 | 2.6 | 1.6 | 2.4 | 2.4 | 2.2 | 1.0 | 2.7 | 0.6 | 2.5 | 2.6 | 2.4 | — | 69 | 32 | 61 | 63 | 41 | 37 |
| 21 | Y-19 | I-11 | 2.5 | 1.6 | 2.5 | 2.4 | 2.1 | 0.9 | 2.7 | 0.5 | 2.5 | 2.6 | 2.3 | — | 68 | 34 | 66 | 65 | 42 | — |
| 22 | Y-19 | II-40 | 2.6 | 1.5 | 2.5 | 2.4 | 2.1 | 0.9 | 2.8 | — | 2.6 | 2.5 | 2.2 | — | 67 | 36 | 65 | 67 | 40 | — |
| 23 | Y-29 | — | 2.6 | 2.0 | 2.5 | 2.4 | 2.3 | 1.6 | 2.9 | 1.7 | 2.9 | 3.1 | 2.8 | 1.2 | 22 | 13 | 20 | 18 | 17 | 17 |
| 24 | Y-29 | I-12 | 2.5 | 1.7 | 2.4 | 2.3 | 2.1 | 1.1 | 2.8 | 1.1 | 3.0 | 2.9 | 2.6 | — | 40 | 23 | 37 | 40 | 24 | 26 |
| 25 | Y-29 | II-13 | 2.5 | 1.6 | 2.4 | 2.4 | 2.1 | 1.0 | 2.8 | 1.0 | 2.9 | 2.9 | 2.6 | — | 42 | 25 | 37 | 39 | 26 | 25 |
| 26 | Y-29 | II-36 | 2.5 | 1.6 | 2.4 | 2.3 | 2.1 | 1.0 | 2.8 | 0.8 | 2.8 | 2.8 | 2.5 | — | 44 | 25 | 39 | 42 | 26 | 25 |

The results in Table - 1 show that the treatments ([B] and [E]), wherein a compound represented by the formula [I] or [II] was employed as a light stabilizer and

TABLE 2

| Sample No. | Cyan coupler | Light stabilizer | Maximum density [A] | [B] | [D] | [E] | Gradation [A] | [B] | [D] | [E] | Dye-image residual rate [A] | [B] | [D] | [E] |
|---|---|---|---|---|---|---|---|---|---|---|---|---|---|---|
| 27 | IV-1 | — | 2.8 | 2.6 | 2.8 | 2.6 | 4.6 | 3.7 | 4.3 | 4.0 | 72 | 65 | 71 | 70 |
| 28 | IV-1 | I-4 | 2.7 | 2.1 | 2.7 | 2.3 | 4.4 | 2.8 | 4.1 | 3.3 | 79 | 70 | 78 | 69 |
| 29 | IV-1 | I-7 | 2.7 | 2.0 | 2.6 | 2.3 | 4.5 | 2.6 | 4.2 | 3.1 | 80 | 71 | 81 | 71 |
| 30 | IV-1 | I-19 | 2.7 | 2.0 | 2.7 | 2.4 | 4.4 | 2.5 | 4.1 | 3.1 | 79 | 74 | 80 | 73 |
| 31 | IV-1 | I-36 | 2.8 | 1.9 | 2.6 | 2.3 | 4.6 | 2.2 | 4.1 | 3.2 | 79 | 73 | 81 | 72 |
| 32 | IV-9 | — | 2.9 | 2.5 | 2.8 | 2.7 | 4.4 | 3.4 | 4.0 | 3.8 | 60 | 57 | 59 | 56 |
| 33 | IV-9 | I-4 | 2.8 | 2.0 | 2.7 | 2.5 | 4.2 | 2.4 | 3.9 | 2.9 | 67 | 59 | 67 | 60 |
| 34 | IV-9 | I-7 | 2.8 | 2.0 | 2.6 | 2.4 | 4.1 | 2.1 | 3.9 | 3.0 | 68 | 60 | 69 | 59 |
| 35 | IV-9 | I-19 | 2.8 | 1.9 | 2.6 | 2.4 | 4.1 | 2.0 | 4.0 | 3.0 | 67 | 62 | 68 | 58 |
| 36 | IV-9 | I-36 | 2.8 | 2.0 | 2.7 | 2.5 | 4.1 | 2.3 | 4.1 | 3.1 | 67 | 61 | 68 | 61 |
| 37 | V-12 | — | 2.8 | 2.7 | 2.7 | 2.6 | 4.8 | 3.1 | 4.3 | 4.2 | 54 | 47 | 52 | 50 |
| 38 | V-12 | I-4 | 2.7 | 2.2 | 2.6 | 2.3 | 4.6 | 2.5 | 4.0 | 3.4 | 61 | 50 | 60 | 52 |
| 39 | V-12 | I-7 | 2.7 | 2.1 | 2.7 | 2.3 | 4.7 | 2.6 | 4.1 | 3.0 | 63 | 54 | 61 | 53 |
| 40 | V-12 | I-19 | 2.7 | 2.2 | 2.6 | 2.2 | 4.6 | 2.5 | 4.1 | 2.9 | 63 | 52 | 61 | 54 |
| 41 | V-12 | I-36 | 2.7 | 2.2 | 2.6 | 2.3 | 4.6 | 2.5 | 4.0 | 3.1 | 64 | 53 | 62 | 54 |

It is apparent from the results in Table - 2 that, even though a a cyan-dye-iamge-formigg coupler was used, the maximum density and gradation did not deteriorate and the light fastness of a dye-image was excellent, when a compound of the invention represented by the formula [I] was used like Example - 1 and at the same time a compound of the invention was used as a preservative for color developer.

EXAMPLE - 3

The following layers were disposed on the reflective support also used in Example - 1 through coating so as to prepare the multi-layered color photographic papers.

Layer 1 . . . A layer containing 1.6 g gelatin and 0.36 g blue-sensitive silver chloro-bromide emulsion, and 0.6 g DNP into which $1.4\times10^{-3}$ mol of yellow coupler shown in Table - 3, 0.5 g of light stabilizer shown in Table - 1 and 0.03 g HQ - 1 having been dissolved.

Layer 2 . . . A layer containing 0.9 g gelatin, and 0.1 g DOP into which 0.06 g HQ - 1 having been dissolved.

Layer 3 . . . A layer containing 0.32 g green-sensitive silver chlorobromide emulsion and 0.01 g anti-irradiation dye (AI - 1), below, and 0.4 g DOP into which $0.8\times10^{-3}$ mol of magenta coupler, below, 0.25 g of light stabilizer STB - 1, below, 0.20 g of light stabilizer, below, and 0.03 go HQ - 1 having been dissolved.

Layer 4 . . . A layer containing 1.5 g gelatin, 0.010 g of antiirradiation dye AI - 2, below, 0.010 g anti-irradiation dye AI - 3, and 0.5 g DOP into which 0.8 g UV - 1 and 0.15 g HQ - 1 having been dissolved.

Layer 5 . . . A layer containing 1.5 g gelatin and 0.24 g red-sensitive silver chloro-bromide emulsion, and 0.5 g DOP into which $1.0\times10^{-3}$mol cyan coupler shown in Table - 3, 0.3 g light stabilizer shown in Table - 3 and 0.02 g HQ - 1 having been dissolved.

Layer 6 . . . A layer containing 1.0 g gelatin, and 0.2 g DOP into which 0.4 g UV -1 having been dissolved.

Layer 7 . . . A layer containing 1.1 g gelatin, 0.02 g polyvinylpyrolidone and 0.09 g 2,4-dichloro-6-hydroxy-s-triazine sodium.

AI-1

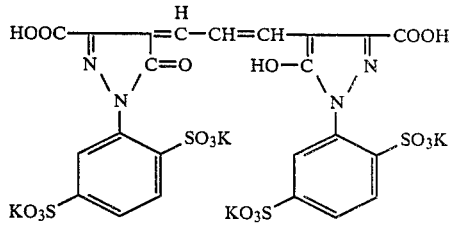

AI-2

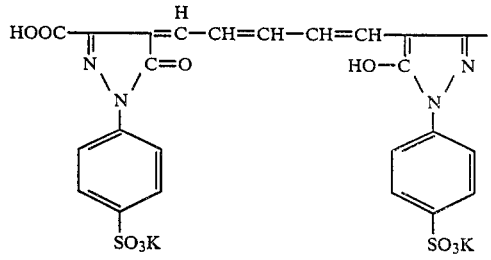

AI-3

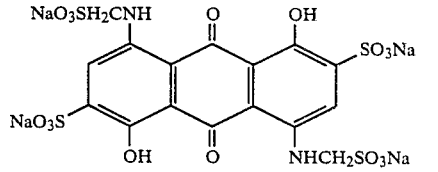

M-1

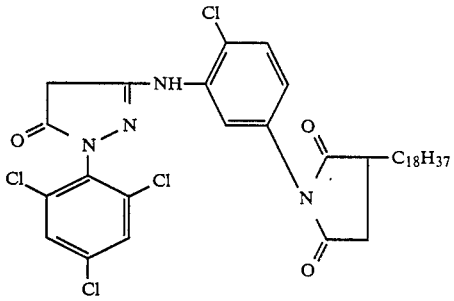

The obtained samples were exposed with monochromatic blue and red lights through an optical wedge, and were subjected to the treatments, [A], [B] and [C] described in Example - 1and the treatment which used the following color developers [G] and [H].

Treatment [G]: time and temperature being identical with those of treatment.

Treatment [H]: time and temperature being identical with those of treatment [C].

Color developer [G]: exemplified 1-aryl-3-pyrazolidone (AP - 2) was added into the color developer [B] at the rate of 50 mg/l. Color developer [H]: AP - 2 was added into the color developer [C] at the rate of 50 mg/l.

The reflecting density of each prepared sample was measured at the maximum density range of each sample, and the results shown in Table - 3 were obtained. At the same time, the light fading properties of cyan- and yellow-dye images were examined in the same manner as Example - 1 and Example - 2. The results, the dye residual rates relative to the initial density 1.0, are shown in Table - 3. In the table, B represents a yellow-dye-mage, and R represents a cyandye-image.

TABLE 3

| Sample No. | Layer 1 Yellow coupler | Layer 1 Light stabilizer | Layer 5 Cyan coupler | Layer 5 Light stabilizer | B Maximum density [A] | [B] | [C] | [G] | [H] | B Dye-image residual rate [A] | [B] | [C] | [G] | [H] |
|---|---|---|---|---|---|---|---|---|---|---|---|---|---|---|
| 42 | Y-4 | — | IV-9 | — | 2.8 | 2.4 | 2.7 | 2.2 | 2.6 | 39 | 30 | 37 | 30 | 38 |
| 43 | Y-4 | I-4 | IV-9 | I-4 | 2.7 | 2.1 | 2.6 | 1.6 | 2.4 | 62 | 43 | 59 | 34 | 58 |
| 44 | Y-4 | I-33 | IV-9 | I-33 | 2.7 | 2.0 | 2.6 | 1.4 | 2.4 | 67 | 42 | 58 | 36 | 58 |
| 45 | Y-4 | II-19 | IV-9 | I-36 | 2.7 | 1.9 | 2.5 | 1.5 | 2.5 | 68 | 40 | 62 | 35 | 61 |
| 46 | Y-4 | II-40 | IV-9 | I-45 | 2.7 | 1.9 | 2.6 | 1.5 | 2.4 | 66 | 44 | 65 | 40 | 64 |
| 47 | Y-19 | — | V-12 | — | 2.9 | 2.2 | 2.7 | 2.0 | 2.6 | 52 | 42 | 50 | 40 | 48 |
| 48 | Y-19 | I-4 | V-12 | I-4 | 2.8 | 1.7 | 2.6 | 1.2 | 2.4 | 73 | 60 | 70 | 57 | 69 |
| 49 | Y-19 | I-36 | V-12 | I-33 | 2.9 | 1.7 | 2.5 | 1.1 | 2.5 | 71 | 58 | 71 | 55 | 70 |
| 50 | Y-19 | II-20 | V-12 | I-36 | 2.9 | 1.6 | 2.5 | 1.2 | 2.4 | 69 | 62 | 70 | 59 | 70 |
| 51 | Y-19 | II-36 | V-12 | I-45 | 2.8 | 1.7 | 2.5 | 1.1 | 2.5 | 72 | 61 | 71 | 59 | 72 |

| Sample No. | Layer 1 Yellow coupler | Layer 1 Light stabilizer | Layer 5 Cyan coupler | Layer 5 Light stabilizer | R Maximum density [A] | [B] | [C] | [G] | [H] | R Dye-image residual rate [A] | [B] | [C] | [G] | [H] |
|---|---|---|---|---|---|---|---|---|---|---|---|---|---|---|
| 42 | Y-4 | — | IV-9 | — | 2.8 | 2.4 | 2.7 | 2.2 | 2.6 | 70 | 60 | 71 | 58 | 70 |
| 43 | Y-4 | I-4 | IV-9 | I-4 | 2.7 | 2.0 | 2.7 | 1.6 | 2.5 | 77 | 64 | 76 | 61 | 75 |
| 44 | Y-4 | I-33 | IV-9 | I-33 | 2.7 | 1.9 | 2.6 | 1.4 | 2.5 | 79 | 63 | 77 | 61 | 75 |
| 45 | Y-4 | II-19 | IV-9 | I-36 | 2.7 | 1.8 | 2.6 | 1.3 | 2.4 | 78 | 63 | 77 | 62 | 76 |
| 46 | Y-4 | II-40 | IV-9 | I-45 | 2.7 | 1.9 | 2.5 | 1.4 | 2.5 | 77 | 64 | 77 | 62 | 75 |
| 47 | Y-19 | — | V-12 | — | 2.8 | 2.5 | 2.7 | 2.2 | 2.6 | 60 | 56 | 58 | 55 | 59 |
| 48 | Y-19 | I-4 | V-12 | I-4 | 2.7 | 2.0 | 2.5 | 1.5 | 2.6 | 69 | 59 | 70 | 60 | 69 |
| 49 | Y-19 | I-36 | V-12 | I-33 | 2.8 | 2.0 | 2.5 | 1.4 | 2.5 | 68 | 59 | 69 | 59 | 69 |
| 50 | Y-19 | II-20 | V-12 | I-36 | 2.7 | 1.9 | 2.6 | 1.4 | 2.5 | 67 | 58 | 67 | 61 | 70 |
| 51 | Y-19 | II-36 | V-12 | I-45 | 2.7 | 2.0 | 2.5 | 1.4 | 2.6 | 69 | 57 | 69 | 60 | 71 |

It is apparent from the results in Table - 3 that in each of the cyan- and yellow-dye-images, similarly to Example - 1 and Example - 2, the maximum density was satisfactorily high and the light fading properties were improved to the extent similar to those of the treatment [A] when the samples containing the compound expressed by the formula [I] or [II] were treated with the color developer [C] containing no benzyl alcohol and having N,N-diethylhydroxylamine of the invention as a preservative.

It is also apparent that the improving effects on maximum density as well as light fading properties were much greater in the case of the color developers [G] and [H] which contain 1-aryl-3-pyrazolidone series compound.

What is claimed is:

1. A process for forming a dye-image comprising the steps of:

imagewise exposing a silver halide photographic light-sensitive material which comprises a support, provided thereon, with at least one silver halide emulsion layer containing a hydrophobic dye-forming coupler and at least one compound selected from the group consisting of compounds having sterically hindbbKred phenol group and polyalkylpiperidine compounds, and color developing said silver halide photographic light-sensitive material with a color developer comprising an aromatic primary amine and an N,N-dialkylhydroxylamine or the water soluble acid salt thereof and not containing benzyl alcohol.

2. The process of claim 1, wherein said compounds having sterically hindered phenol group are represented by Formula [I]:

Formula [I]

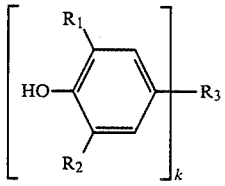

wherein $R_1$ and $R_2$ are each represent a straight or branched chain alkyl group containing three to eight carbon atoms, $R_3$ is a k-valent organic group and k is an integer 1 to 6.

3. The process of claim 1, wherein said polyalkylpiperidine compounds are represented by Formula [II]:

Formula [II]

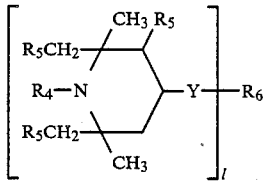

wherein $R_4$ is an alkyl group, an alkenyl group, an alkinyl group, or an acyl group, $R_5$ is a hydrogen atom or an alkyl group, Y is —O—or =NR group, R is an alkyl group, $R_6$ is a l-valent organic group and l is an integer 1 to 4.

4. The process of claim 1, wherein said hydrophobic dye-forming coupler is a yellow dye-forming coupler or a cyan dye-forming coupler.

5. The process of claim 2, wherein said hydrophobic coupler is a yellow dye-forming coupler or a cyan dye forming coupler and an amount of the compound represented by Formula [I] contained in said silver halide emulsion layer is from 5 to 100% by weight to said yellow dye-forming coupler or said cyan dye-forming coupler contained in said silver halide emulsion layer.

6. The process of claim 5, wherein an amount of said compound represented by Formula [I] is from 10 to 50% by weight to said yellow dye-forming coupler or said cyan dye-forming coupler.

7. The process of claim 3, wherein said hydrophobic coupler is a yellow dye-forming coupler or a cyan dye-forming coupler and an amount of the compound represented by Formula [II] contained in said silver halide emulsion layer is from 5 to 100% by weight to said yellow dye-forming coupler or said cyan dye-forming coupler contained in said silver halide emulsion layer.

8. The process of claim 7, wherein an amount of said compound represented by Formula [II] is from 10 to 50% by weight to said yellow dye-forming coupler or said cyan dye-forming coupler.

9. The process of claim 4, wherein said yellow dye-forming coupler contained in said emulsion layer is a yellow dye-forming coupler represented by Formula [III]:

Formula [III]

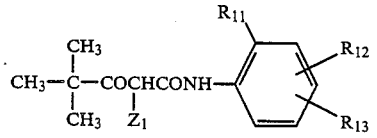

wherein $R_{11}$ is a halogen atom or an alkoxy group, $R_{12}$ is a hydrogen atom, a halogen atom or an alkoxy group, $R_{13}$ is an acylamino group, an alkoxycarbonyl group, an alkylsulfamoyl group, an arylsulfamoyl group, an arylsulfonamido group, an alkylureido group, an arylureido group, a succinimido group, an alkoxy group or an aryloxy group and $Z_1$ is a group capable of being split off upon reaction of the coupler residue with the oxidized product of the color developing agent.

10. The process of claim 9, wherein said yellow dye-forming coupler represented by Formula [III] contained in said silver halide emulsion layer is from 0.05 to 2 mol per mol of a siver halide contained in said silver halide emulsion layer.

11. The process of claim 10, wherein said yellow dye-forming coupler represented by Formula [III] contained in said silver halide emulsion layer is from 0.1 to 0.7 mol per mol of a silver halide contained in said silver halide emulsion layer.

12. The process of claim 4, wherein said cyan dye-forming coupler contained in said emulsion layer is a cyan dye-forming coupler represented by Formula [IV] or [V]:

Formula [IV]

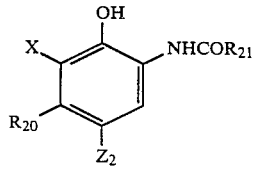

wherein X is a halogen atom, $R_{20}$ is an alkyl group containing one to six carbon atoms, $R_{21}$ is a ballast group and $Z_2$ is a group capable of being splitted off upon reaction of the coupler residue with the oxidized product of the color developing agent, Formula [V]

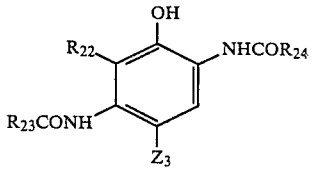

wherein $R_{22}$ is a hydrogen atom, a halogen atom, an acyl group, an alkyl group or an atomic group necessary to complete a six membered ring together with the group represented by $R_{23}$, $R_{23}$ is an alkyl group or an aryl group, $R_{24}$ is an alkyl group, a cycloalkyl group, an aryl group or a —$NHR_{25}$ group, $R_{25}$ is an alkyl group or an aryl group, and $Z_3$ is the same as $Z_2$ of Formula [IV].

13. The process of claim 9, wherein said cyan dye-forming coupler represented by Formula [IV] or [V] contained in said silver halide emulsion layer is from 0.05 to 2 mol per mol of a silver halide contained in said silver halide emulsion layer.

14. The process of claim 13, wherein said cyan dye-forming coupler represented by Formula [IV] or [IV] contained in said silver halide emulsion layer is from 0.1 to 0.7 mol per mol of a silver halide contained in said silver halide emulsion layer.

15. The process of claim 1, wherein the alkyl groups of said N,N-dialkyhydroxylamine are each an alkyl group having one to four carbon atoms.

16. The process of claim 1, wherein said N,N-dialkylhydoxylamine contained in said color developer is 0.2 to 15 g per l of said color developer.

17. The process of claim 17, wherein said N,N-dialkylhydroxylamine contained in said color developr is 0.5 to 10 g per l of said color developer.

* * * * *